US009890801B2

(12) United States Patent
Takahashi et al.

(10) Patent No.: US 9,890,801 B2
(45) Date of Patent: Feb. 13, 2018

(54) HYDRAULIC DRIVE SYSTEM FOR CONSTRUCTION MACHINE

(71) Applicant: Hitachi Construction Machinery Co., Ltd., Koka-shi (JP)

(72) Inventors: Kiwamu Takahashi, Koka (JP); Yasutaka Tsuruga, Moriyama (JP); Yoshifumi Takebayashi, Koka (JP); Kazushige Mori, Koka (JP); Natsuki Nakamura, Koka (JP)

(73) Assignee: Hitachi Construction Machinery Tierra Co., Ltd., Koka-shi (JP)

( * ) Notice: Subject to any disclaimer, the term of this patent is extended or adjusted under 35 U.S.C. 154(b) by 254 days.

(21) Appl. No.: 14/767,480

(22) PCT Filed: Mar. 17, 2014

(86) PCT No.: PCT/JP2014/057207
§ 371 (c)(1),
(2) Date: Aug. 12, 2015

(87) PCT Pub. No.: WO2014/148449
PCT Pub. Date: Sep. 25, 2014

(65) Prior Publication Data

US 2015/0377258 A1 Dec. 31, 2015

(30) Foreign Application Priority Data

Mar. 22, 2013 (JP) ..... 2013-060962

(51) Int. Cl.
*F15B 11/16* (2006.01)
*F15B 11/17* (2006.01)
(Continued)

(52) U.S. Cl.
CPC ..... *F15B 11/166* (2013.01); *E02F 3/325* (2013.01); *E02F 9/2239* (2013.01);
(Continued)

(58) Field of Classification Search
CPC ..... F15B 11/162; F15B 11/165; F15B 11/166; E02F 3/325; E02F 9/2239; E02F 9/2292
(Continued)

(56) References Cited

U.S. PATENT DOCUMENTS 4,073,141 A * 2/1978 Lohbauer ..... B62D 11/18 60/421
5,129,230 A * 7/1992 Izumi ..... E02F 9/2225 60/450
(Continued)

FOREIGN PATENT DOCUMENTS

DE 34 33 896 A1 3/1985
EP 1 416 096 A1 5/2004
(Continued)

OTHER PUBLICATIONS

International Preliminary Report on Patentability (PCT/IB/338 & PC-MB/373) issued in PCT Application No. PCT/JP2014/057207 dated Oct. 1, 2015, including English translation of document C2 (Japanese language Written Opinion (PCT/ISA/237) previously filed on Aug. 12, 2015 (six (6) pages).
(Continued)

*Primary Examiner* — Michael Leslie
*Assistant Examiner* — Richard Drake
(74) *Attorney, Agent, or Firm* — Crowell & Moring LLP

(57) ABSTRACT

In addition to a main pump 102 having two delivery ports 102*a* and 102*b* and performing the load sensing control, two subsidiary pumps 202 and 302 for the load sensing control for respectively performing assist driving on a boom cylinder 3*a* and an arm cylinder 3*b* are provided. When driving the boom cylinder 3*a* or the arm cylinder 3*b*, a selector valve 141 or 241 is switched and flows of hydraulic fluid are merged together and supplied to the boom cylinder 3*a* or the arm cylinder 3*b*. When driving actuators other than the
(Continued)

boom cylinder 3*a* or the arm cylinder 3*b*, only the hydraulic fluid from the main pump is supplied to the actuators. In short, the hydraulic drive system is configured so that two specific actuators having great demanded flow rates and tending to have a great load pressure difference between each other when driving at the same time can be driven with hydraulic fluid delivered from separate delivery ports. With this configuration, wasteful energy consumption due to pressure loss in a pressure compensating valve can be suppressed, and in cases of driving an actuator of a low demanded flow rate, the hydraulic pump can be used at a point where the volume efficiency is high.

7 Claims, 2 Drawing Sheets

(51) Int. Cl.
*E02F 3/32* (2006.01)
*E02F 9/22* (2006.01)

(52) U.S. Cl.
CPC ..... *E02F 9/2285* (2013.01); *E02F 9/2292* (2013.01); *E02F 9/2296* (2013.01); *F15B 11/17* (2013.01); *F15B 2211/20553* (2013.01); *F15B 2211/20576* (2013.01); *F15B 2211/253* (2013.01); *F15B 2211/2656* (2013.01); *F15B 2211/30535* (2013.01); *F15B 2211/30595* (2013.01); *F15B 2211/6658* (2013.01); *F15B 2211/7135* (2013.01); *F15B 2211/7142* (2013.01); *F15B 2211/88* (2013.01)

(58) Field of Classification Search
USPC ..... 60/423, 484, 486, 422, 429; 414/685
See application file for complete search history.

(56) References Cited

U.S. PATENT DOCUMENTS 5,315,828 A * 5/1994 Stellwagen ..... E02F 9/2221 60/426
6,244,048 B1 * 6/2001 Tanaka ..... E02F 9/2242 60/421
7,500,360 B2 * 3/2009 Udagawa ..... E02F 9/2228 60/421
7,571,558 B2 * 8/2009 Horii ..... E02F 9/2239 37/348
8,464,826 B2 * 6/2013 Yamada ..... B62D 11/005 180/306
8,943,819 B2 * 2/2015 Knussman ..... F15B 7/006 60/421
8,973,358 B2 * 3/2015 Kuehn ..... F15B 11/17 60/420
9,328,757 B2 * 5/2016 Horii ..... F15B 15/00
2010/0218493 A1 * 9/2010 Nakamura ..... E02F 9/2235 60/426
2012/0067443 A1 3/2012 Horii
2013/0287601 A1 * 10/2013 Mori ..... E02F 9/2225 417/364
2013/0312399 A1 * 11/2013 Hiraku ..... F15B 15/18 60/422
2014/0060032 A1 * 3/2014 Pfaff ..... E02F 9/2235 60/422
2014/0069091 A1 * 3/2014 Franzoni ..... F15B 11/162 60/422
2015/0204054 A1 * 7/2015 Tsuruga ..... F15B 11/17 414/685
2016/0115974 A1 * 4/2016 Takahashi ..... F15B 11/17 60/421

FOREIGN PATENT DOCUMENTS

JP 9-25652 A 1/1997
JP 2581858 Y2 9/1998
JP 2001-193705 A 7/2001
JP 2004-150198 A 5/2004
JP 2011-196438 A 10/2011
JP 2011-247282 A 12/2011
JP 2012-67459 A 4/2012
WO WO 94/10455 A1 5/1994
WO WO 2012/111525 A1 8/2012

OTHER PUBLICATIONS

International Search Report (PCT/ISA/210) dated Jun. 10, 2014, with English translation (four (4) pages).
Written Opinion (PCT/ISA/237) dated Jun. 10, 2014 (three (3) pages).

* cited by examiner

HYDRAULIC DRIVE SYSTEM FOR CONSTRUCTION MACHINE

TECHNICAL FIELD

The present invention relates to a hydraulic drive system for a construction machine such as a hydraulic excavator. In particular, the present invention relates to a hydraulic drive system for a construction machine comprising a pump device and a load sensing system, the pump device having two delivery ports whose delivery flow rates are controlled by a single pump regulator (pump control unit), the load sensing system controlling delivery pressures of the pump device to be higher than the maximum load pressure of actuators.

BACKGROUND ART

A hydraulic drive system having a load sensing system for controlling the delivery flow rate of a hydraulic pump (main pump) so that the delivery pressure of the hydraulic pump becomes higher by a target differential pressure than the maximum load pressure of a plurality of actuators as described in Patent Document 1 is widely used today as the hydraulic drive systems for construction machines such as hydraulic excavators.

There has also been known a two-pump load sensing system as an example of the load sensing system, in which two hydraulic pumps are arranged associated with a first actuator group and a second actuator group as described in Patent Document 2 and Patent Document 3.

In the two-pump load sensing system described in Patent Document 2, a separation/confluence selector valve is arranged between delivery hydraulic lines of the two hydraulic pumps. When the load pressure difference among the actuators included in the first and second actuator groups is small, the delivery flow rates of the first and second hydraulic pumps are controlled on the basis of the maximum load pressure of the first and second actuator groups, and the delivery flows from the two hydraulic pumps are merged together and supplied to the actuators.

In the two-pump load sensing system described in Patent Document 3, the maximum displacement of one of the two hydraulic pumps (first hydraulic pump) is set larger than the maximum displacement of the other hydraulic pump (second hydraulic pump). The maximum displacement of the first hydraulic pump is set at a displacement enough for driving an actuator whose demanded flow rate is the highest (assumed to be an arm cylinder). A specific actuator (assumed to be a boom cylinder) is driven by the delivery flow from the second hydraulic pump. Further, a confluence valve is arranged on the first hydraulic pump's side, by which the delivery flow from the second hydraulic pump can be merged with the delivery flow from the first hydraulic pump and the merged delivery flow can be supplied to the specific actuator (assumed to be the boom cylinder).

Further, Patent Document 4 describes a load sensing system in which a hydraulic pump of the split flow type having two delivery ports is employed instead of two hydraulic pumps. In the system, the delivery flow rates of first and second delivery ports can be controlled independently of each other on the basis of the maximum load pressure of a first actuator group and the maximum load pressure of a second actuator group, respectively. Also in this system, the separation/confluence selector valve (travel independent valve) is arranged between the delivery hydraulic lines of the two delivery ports. In cases like performing the traveling only or using the dozer equipment while traveling, the separation/confluence selector valve is switched to a separation position and the delivery flows from the two delivery ports are supplied independently to the actuators. In cases of driving actuators not for the traveling or the dozer (e.g., boom cylinder, arm cylinder, etc.), the separation/confluence selector valve is switched to a confluence position so that the delivery flows from the two delivery ports can be merged together and supplied to the actuators.

PRIOR ART DOCUMENT

Patent Documents

Patent Document 1: JP-2001-193705-A
Patent Document 2: Japanese Utility Model Registration No. 2581858
Patent Document 3: JP-2011-196438-A
Patent Document 4: JP-2012-67459-A

SUMMARY OF THE INVENTION

Problem to be Solved by the Invention

In hydraulic drive systems having an ordinary type of load sensing system like the one described in Patent Document 1, the delivery pressure of the hydraulic pump is controlled to be constantly higher by a certain preset pressure than the maximum load pressure of a plurality of actuators. When an actuator of a high load pressure and an actuator of a low load pressure are driven in combination (e.g., when the boom raising operation (load pressure: high) and the arm crowding operation (load pressure: low) are performed at the same time like the so-called "leveling"), the delivery pressure of the hydraulic pump is controlled to be higher by a certain preset pressure than the high load pressure of the boom cylinder. In this case, a pressure compensating valve for driving the arm cylinder and for preventing excessive inflow into the arm cylinder of the low load pressure is throttled, and thus pressure loss in the pressure compensating valve leads to wasteful energy consumption.

In hydraulic drive systems having the two-pump load sensing system described in Patent Document 2, the wasteful energy consumption as the problem with the load sensing system of Patent Document 1 can be suppressed since the system comprises two hydraulic pumps (first and second hydraulic pumps) and the delivery flow rates of the first and second hydraulic pumps can be controlled independently of each other on the basis of the maximum load pressure of the first actuator group and the maximum load pressure of the second actuator group, respectively.

However, the two-pump load sensing system described in Patent Document 2 has another problem.

In construction machines such as hydraulic excavators, the necessary flow rate (demanded flow rate) of each actuator can vary greatly depending on the type of the actuator and the status of the operation. In the case of hydraulic excavators, for example, the arm cylinder and the boom cylinder tend to need higher flow rates than the other actuators such as the travel motors and the bucket cylinder.

In such cases, if the displacements (maximum displacements) of the first and second hydraulic pumps are set to suit the demanded flow rates of the arm cylinder and the boom cylinder, the displacement of each pump becomes extremely large. Thus, the volume efficiency of the hydraulic pumps deteriorates since the first or second hydraulic pump is driven at a small displacement in the variable-displacement range at times of driving an actuator of a low demanded flow rate (e.g., bucket cylinder).

Incidentally, if the two-pump load sensing system of Patent Document 2 is configured to drive the boom cylinder and the arm cylinder by merging together the delivery flows from the two hydraulic pumps, a problem like the problem with the one-pump load sensing system of Patent Document 1 arises since wasteful energy consumption in the combined operation of the boom cylinder and the arm cylinder increases.

In the two-pump load sensing system described in Patent Document 3, in cases where there is a great difference between the necessary flow rate of the boom cylinder and the arm cylinder and the necessary flow rate of the other actuators (travel motors, bucket cylinder, etc.), the displacements of the two hydraulic pumps are set on the basis of the necessary flow rate of the boom cylinder and the arm cylinder. Thus, the two-pump load sensing system of Patent Document 3 shares the same problem with Patent Document 2 in that the hydraulic pumps are driven at a small displacement in comparison with the entire displacement (entire volume) in cases like driving an actuator of a low flow rate and the volume efficiency of the hydraulic pumps is deteriorated.

In the load sensing system described in Patent Document 4, in cases other than the traveling or using the dozer equipment, the delivery flows from the two delivery ports are merged together and the two delivery ports are made to function as one pump. Therefore, this load sensing system has the same problem as Patent Document 1: wasteful energy consumption occurs due to the pressure loss in a pressure compensating valve in the combined operation like performing the boom raising (load pressure: high) and the arm crowding (load pressure: low) at the same time). Further, since the hydraulic fluid flows delivered from the two delivery ports are merged together and supplied to the actuators, this load sensing system shares the same problem with Patent Document 2 in that the hydraulic pumps are driven at a small displacement in comparison with the entire displacement (volume) in cases like driving an actuator of a low flow rate and the volume efficiency of the hydraulic pumps is deteriorated.

The object of the present invention is to provide a hydraulic drive system for a construction machine capable of suppressing the wasteful energy consumption due to the pressure loss in a pressure compensating valve by making it possible to drive two specific actuators (having great demanded flow rates and tending to have a great load pressure difference between each other when driven at the same time) with hydraulic fluid delivered from separate delivery ports, and also capable of using each hydraulic pump at a point where the volume efficiency is high in cases of driving an actuator of a low demanded flow rate other than the two specific actuators.

Means for Solving the Problem (1) To achieve the above object, the present invention provides a hydraulic drive system for a construction machine, comprising: a first pump device having first and second delivery ports; a plurality of actuators which are driven by hydraulic fluid delivered from the first and second delivery ports; a plurality of flow control valves which control the flow rates of the hydraulic fluid supplied from the first and second delivery ports to the actuators; a plurality of pressure compensating valves each of which controls the differential pressure across each of the flow control valves so that the differential pressure becomes equal to a target differential pressure; and a first pump control unit including a first load sensing control unit which controls the displacement of the first pump device so that the delivery pressures of the first and second delivery ports become higher by a target differential pressure than the maximum load pressure of actuators driven by the hydraulic fluid delivered from the first and second delivery ports. The plurality of actuators include a first actuator group and a second actuator group, the first actuator group including a first specific actuator, the second actuator group including a second specific actuator. The first and second specific actuators are actuators having greater demanded flow rates than other actuators and tending to have a great load pressure difference between each other when driven at the same time. The actuators of the first actuator group other than the first specific actuator and the actuators of the second actuator group other than the second specific actuator are actuators having less demanded flow rates than the first and second specific actuators. The actuators of the first actuator group other than the first specific actuator are connected to the first delivery port of the first pump device via associated pressure compensating valves and flow control valves. The actuators of the second actuator group other than the second specific actuator are connected to the second delivery port of the first pump device via associated pressure compensating valves and flow control valves. The hydraulic drive system further comprises: a second pump device having a third delivery port to which the first specific actuator of the first actuator group is connected via an associated pressure compensating valve and flow control valve; a third pump device having a fourth delivery port to which the second specific actuator of the second actuator group is connected via an associated pressure compensating valve and flow control valve; a second pump control unit including a second load sensing control unit which controls the displacement of the second pump device so that the delivery pressure of the third delivery port becomes higher by a target differential pressure than the load pressure of the first specific actuator; a third pump control unit including a third load sensing control unit which controls the displacement of the third pump device so that the delivery pressure of the fourth delivery port becomes higher by a target differential pressure than the load pressure of the second specific actuator; a first selector valve which interrupts communication between the first delivery port and the third delivery port when only one or more actuators other than the first specific actuator are driven among the actuators of the first actuator group, while establishing communication between the first delivery port and the third delivery port when at least the first specific actuator is driven among the actuators of the first actuator group; and a second selector valve which interrupts communication between the second delivery port and the fourth delivery port when only one or more actuators other than the second specific actuator are driven among the actuators of the second actuator group, while establishing communication between the second delivery port and the fourth delivery port when at least the second specific actuator is driven among the actuators of the second actuator group.

By providing the second and third pump devices as assist pumps specifically for driving the first and second specific actuators as described above, it becomes possible to drive the first and second specific actuators (having great demanded flow rates and tending to have a great load pressure difference between each other when driven at the same time) with hydraulic fluid delivered from separate delivery ports.

Therefore, when an actuator of a high load pressure (first specific actuator) and an actuator of a low load pressure (second specific actuator) are driven in combination (e.g., the so-called "leveling operation" in which the boom and the arm are operated at the same time), the delivery pressure of the delivery port on the low load pressure actuator's side can be controlled independently. Consequently, the wasteful energy consumption in the pressure compensating valve for the low load pressure actuator is prevented and operation with high efficiency becomes possible.

Further, since the actuators of the first actuator group other than the first specific actuator are driven by the hydraulic fluid delivered from the first delivery port of the first pump device and the actuators of the second actuator group other than the second specific actuator are driven by the hydraulic fluid delivered from the second delivery port of the first pump device, the first pump device can be used at a point of higher efficiency in cases of driving an actuator of a low demanded flow rate.

(2) Preferably, in the above hydraulic drive system (1) for a construction machine, the actuators of the first actuator group other than the first specific actuator include a third specific actuator, the actuators of the second actuator group other than the second specific actuator include a fourth specific actuator, and the third and fourth specific actuators are actuators achieving a prescribed function by having supply flow rates equivalent to each other when driven at the same time. The hydraulic drive system further comprises a third selector valve which interrupts communication between the first delivery port and the second delivery port of the first pump device at times other than when the third and fourth specific actuators and at least another actuator are driven at the same time, while establishing communication between the first delivery port and the second delivery port of the first pump device when the third and fourth specific actuators and at least another actuator are driven at the same time.

With this configuration, when the third and fourth specific actuators and one of the first and second actuators (three actuators) are driven at the same time, flows of the hydraulic fluid from the first and second delivery ports of the first pump device and one of the third and fourth delivery ports of the second and third pump devices (three delivery ports) are merged together and supplied to the three actuators. When the third and fourth specific actuators and an actuator of the first actuator group other than the first or third specific actuator or an actuator of the second actuator group other than the second or fourth specific actuator are driven at the same time, flows of the hydraulic fluid from the first and second delivery ports of the first pump device (two delivery ports) are merged together and supplied to the actuators. Therefore, when the third and fourth specific actuators and at least another actuator are driven at the same time, equal amounts of hydraulic fluid can be supplied to the third and fourth specific actuators by operating the control levers of the third and fourth specific actuators at equal input amounts (operation amounts). Consequently, excellent operability in the combined operation can be provided.

(3) Preferably, the above hydraulic drive system (1) or (2) for a construction machine further comprises a control pressure generation circuit which generates pressure for controlling hydraulic devices including the pressure compensating valves, the first pump control unit, the second pump control unit, and the third pump control unit. When only one or more actuators other than the first specific actuator are driven among the actuators of the first actuator group, a differential pressure between the delivery pressure of the first delivery port of the first pump device and the maximum load pressure of the actuators other than the first specific actuator is lead as the target differential pressure to the first pump control unit and the pressure compensating valves related to the actuators other than the first specific actuator. When at least the first specific actuator is driven among the actuators of the first actuator group, a differential pressure between the delivery pressure of the first delivery port of the first pump device or the fourth delivery port of the second pump device and the maximum load pressure of the first actuator group is led as the target differential pressure to the first pump control unit and the pressure compensating valves related to the second pump device and the first actuator group. When only one or more actuators other than the second specific actuator are driven among the actuators of the second actuator group, a differential pressure between the delivery pressure of the second delivery port of the first pump device and the maximum load pressure of the actuators other than the second specific actuator is led as the target differential pressure to the first pump control unit and the pressure compensating valves related to the actuators other than the second specific actuator. When at least the second specific actuator is driven among the actuators of the second actuator group, a differential pressure between the delivery pressure of the second delivery port of the first pump device or the third delivery port of the third pump device and the maximum load pressure of the second actuator group is lead as the control pressure generation circuit leads the target differential pressure to the first pump control unit and the pressure compensating valves related to the third pump device and the second actuator group.

With this configuration, the load sensing control and the control of the pressure compensating valves can be performed appropriately according to the load pressures of the currently driven actuators.

(4) Preferably, any one of the above hydraulic drive systems (1)-(3) for a construction machine further comprises: a first unload valve which shifts to the open state and returns the hydraulic fluid delivered from the first delivery port of the first pump device to a tank when the delivery pressure of the first delivery port of the first pump device becomes higher by a prescribed pressure than the maximum load pressure of the actuators other than the first specific actuator when only one or more actuators other than the first specific actuator are driven among the actuators of the first actuator group; a second unload valve which shifts to the open state and returns the hydraulic fluid delivered from the first delivery port of the first pump device or the third delivery port of the second pump device to the tank when the delivery pressure of the first delivery port of the first pump device or the third delivery port of the second pump device becomes higher by a prescribed pressure than the maximum load pressure of the first actuator group when at least the first specific actuator is driven among the actuators of the first actuator group; a third unload valve which shifts to the open state and returns the hydraulic fluid delivered from the second delivery port of the first pump device to the tank when the delivery pressure of the second delivery port of the first pump device becomes higher by a prescribed pressure than the maximum load pressure of the actuators other than the second specific actuator when only one or more actuators other than the second specific actuator are driven among the actuators of the second actuator group; and a fourth unload valve which shifts to the open state and returns the hydraulic fluid delivered from the second delivery port of the first pump device or the fourth delivery port of the second pump device to the tank when the delivery pressure of the second delivery port of the first pump device or the fourth delivery port of the third pump device becomes higher by a prescribed pressure than the maximum load pressure of the second actuator group when at least the second specific actuator is driven among the actuators of the second actuator group.

With this configuration, it becomes possible to appropriately control the pressures of the first and second delivery ports of the first pump device and the third and fourth delivery ports of the second and third pump devices independently of one another according to the load pressures of the currently driven actuators in any case of single driving or combined driving of actuators.

Further, as a result, when an actuator of a high load pressure (first specific actuator) and an actuator of a low load pressure (second specific actuator) are driven in combination (e.g., the so-called "leveling operation" in which the boom and the arm are operated at the same time), the wasteful energy consumption in the pressure compensating valve on the low load pressure actuator's side is prevented and operation with high efficiency becomes possible.

(5) Preferably, in the above hydraulic drive system (1) or (2) for a construction machine, the first pump control unit further includes a torque control unit having a first torque control actuator to which the delivery pressure of the first delivery port is led, a second torque control actuator to which the delivery pressure of the second delivery port is led, and a third torque control actuator to which average pressure of the delivery pressures of the third and fourth delivery ports is led. The first and second torque control actuators are configured to decrease the displacement of the first pump device with the increase in average pressure of the delivery pressures of the first and second delivery ports. The third torque control actuator is configured to decrease the displacement of the first pump device with the increase in the average pressure of the delivery pressures of the third and fourth delivery ports.

With this configuration, even when the load pressure of one actuator increases significantly in a combined operation of driving an actuator of the first actuator group and an actuator of the second actuator group (two actuators, for example) at the same time, the displacement of the first pump device is controlled by torque control with the average pressure of the delivery pressures of the first and second delivery ports and the average pressure of the delivery pressures of the third and fourth delivery ports. Consequently, the drop in the driving speed of the actuator due to a significant decrease in the displacement of the first pump device can be prevented and excellent operability in the combined operation can be secured.

(6) Preferably, in any one of the above hydraulic drive systems (1)-(5) for a construction machine, the first and second specific actuators are a boom cylinder and an arm cylinder for driving a boom and an arm of a hydraulic excavator, and one of the actuators of one of the first and second actuator groups is a bucket cylinder for driving a bucket of the hydraulic excavator.

With this configuration, the wasteful energy consumption due to the pressure loss in a pressure compensating valve can be suppressed in the so-called leveling operation in which the boom and the arm are operated at the same time. Further, in cases of driving the bucket cylinder whose demanded flow rate is lower than those of the boom cylinder and the arm cylinder, the first pump device can be used at a point where the volume efficiency is high.

(7) Preferably, in any one of the above hydraulic drive systems (2)-(6) for a construction machine, the third and fourth specific actuators are left and right travel motors for driving a track structure of a hydraulic excavator.

With this configuration, when the left and right travel motors and at least another actuator are driven at the same time, flows of the hydraulic fluid from two delivery ports or three delivery ports are merged together and supplied to the actuators. Therefore, equal amounts of hydraulic fluid can be supplied to the left and right travel motors by operating the control levers of the left and right travel motors at equal input amounts (operation amounts). This makes it possible to drive the other actuator(s) while maintaining the straight traveling property and to achieve excellent travel combined operation.

Effect of the Invention

According to the present invention, it becomes possible to drive two specific actuators (having great demanded flow rates and tending to have a great load pressure difference between each other when driven at the same time) with hydraulic fluid delivered from separate delivery ports. Therefore, the delivery pressure of the delivery port on the low load pressure actuator's side can be controlled independently. Consequently, the wasteful energy consumption in the pressure compensating valve for the low load pressure actuator is prevented and operation with high efficiency becomes possible. Further, the first pump device can be used at a point of higher efficiency in cases of driving an actuator of a low demanded flow rate.

When actuators achieving a prescribed function by having supply flow rates equivalent to each other when driven at the same time and at least another actuator are driven at the same time, flows of the hydraulic fluid from the first and second delivery ports and one of the third and fourth delivery ports (three delivery ports) or from the first and second delivery ports (two delivery ports) are merged together and supplied to the actuators. Therefore, when the third and fourth specific actuators and at least another actuator are driven at the same time, equal amounts of hydraulic fluid can be supplied to the third and fourth specific actuators by operating the control levers of the third and fourth specific actuators at equal input amounts (operation amounts). Consequently, excellent operability in the combined operation can be provided.

The displacement of the first pump device is controlled by torque control with the average pressure of the delivery pressures of the first and second delivery ports and the average pressure of the delivery pressures of the third and fourth delivery ports. Therefore, even when the load pressure of one actuator increases significantly in the combined operation, the drop in the driving speed of the actuator due to a significant decrease in the displacement of the first pump device can be prevented and excellent operability in the combined operation can be secured.

In the so-called leveling operation in which the boom and the arm are operated at the same time, the wasteful energy consumption due to the pressure loss in a pressure compensating valve can be suppressed, and the first pump device can be used at a point where the volume efficiency is high in cases of driving the bucket cylinder whose demanded flow rate is lower than those of the boom cylinder and the arm cylinder.

When the left and right travel motors and at least another actuator are driven at the same time, flows of the hydraulic fluid from two delivery ports or three delivery ports are merged together and supplied to the actuators. Therefore, equal amounts of hydraulic fluid can be supplied to the left and right travel motors by operating the control levers of the left and right travel motors at equal input amounts. This makes it possible to drive the other actuator(s) while maintaining the straight traveling property and to achieve excellent operability in the travel combined operation.

MODE FOR CARRYING OUT THE INVENTION

Figure 1:
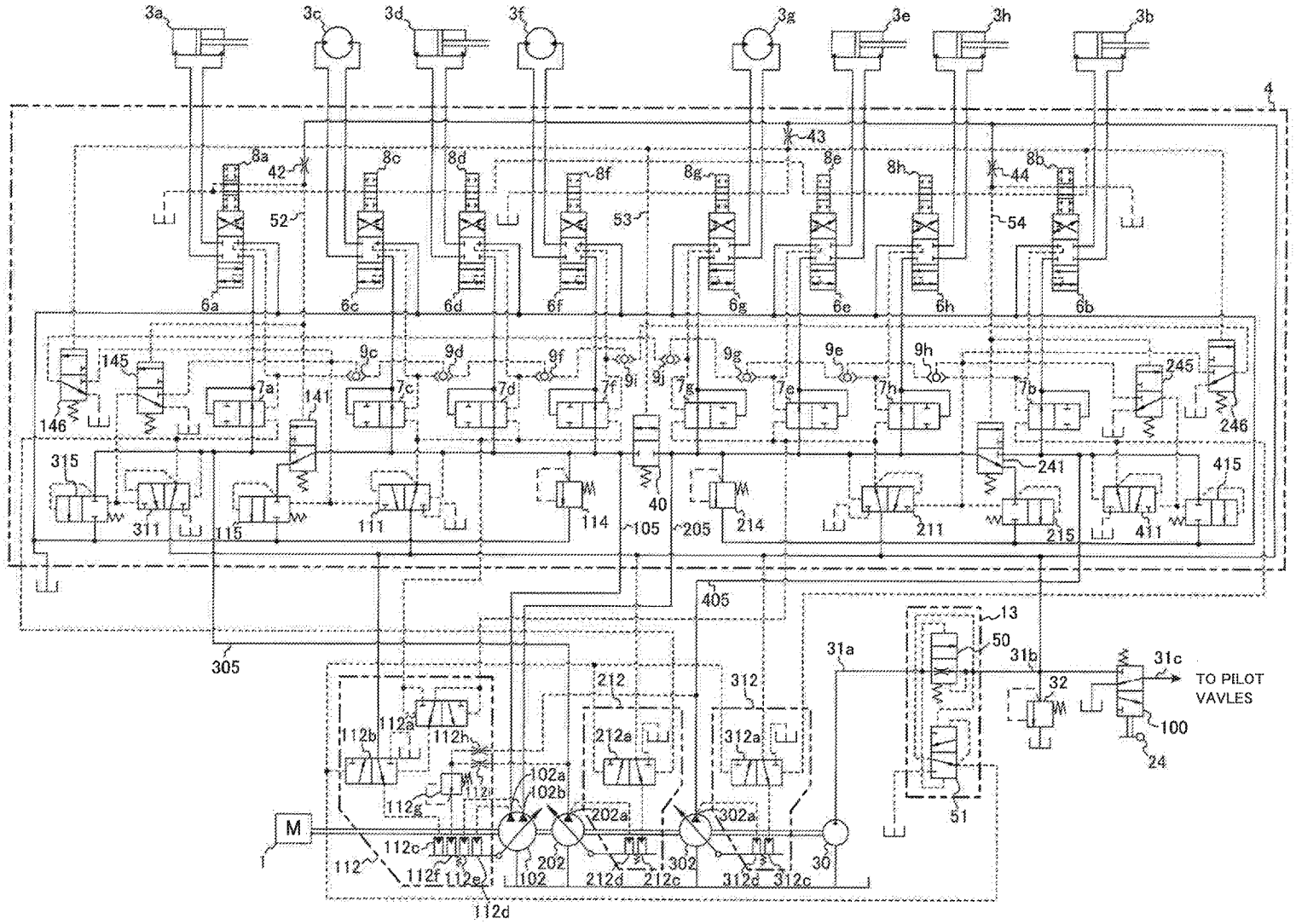
FIG. 1 is a schematic diagram showing a hydraulic drive system for a hydraulic excavator (construction machine) in accordance with an embodiment of the present invention.

Referring now to the drawings, a description will be given in detail of a preferred embodiment of the present invention.

Configuration

FIG. 1 is a schematic diagram showing a hydraulic drive system for a hydraulic excavator (construction machine) in accordance with an embodiment of the present invention.

Referring to FIG. 1, the hydraulic drive system according to this embodiment comprises a prime mover 1, a main pump 102 (first pump device), a subsidiary pump 202 (second pump device), a subsidiary pump 302 (third pump device), actuators 3*a*, 3*b*, 3*c*, 3*d*, 3*e*, 3*f*, 3*g* and 3*h*, a control valve unit 4, a regulator 112 (first pump control unit), a regulator 212 (second pump control unit), and a regulator 312 (third pump control unit). The prime mover 1 (e.g., diesel engine) drives the main pump 102, the subsidiary pumps 202 and 302, and a pilot pump 30 (explained later). The main pump 102 (first pump device) is a variable displacement pump of the split flow type having first and second delivery ports 102*a* and 102*b*. The subsidiary pump 202 (second pump device) is a variable displacement pump having a third delivery port 202*a*. The subsidiary pump 302 (third pump device) is a variable displacement pump having a fourth delivery port 302*a*. The actuators 3*a*, 3*b*, 3*c*, 3*d*, 3*e*, 3*f*, 3*g* and 3*h* are driven by hydraulic fluid delivered from the first and second delivery ports 102*a* and 102*b* of the main pump 102, the third delivery port 202*a* of the subsidiary pump 202 and the fourth delivery port 302*a* of the subsidiary pump 302. The control valve unit 4 controls the flow of the hydraulic fluid supplied from the first and second delivery ports 102*a* and 102*b* of the main pump 102, the third delivery port 202*a* of the subsidiary pump 202 and the fourth delivery port 302*a* of the subsidiary pump 302 to the actuators 3*a*, 3*b*, 3*c*, 3*d*, 3*e*, 3*f*, 3*g* and 3*h*. The regulator 112 (first pump control unit) is used for controlling the delivery flow rates of the first and second delivery ports 102*a* and 102*b* of the main pump 102. The regulator 212 (second pump control unit) is used for controlling the delivery flow rate of the third delivery port 202*a* of the subsidiary pump 202. The regulator 312 (third pump control unit) is used for controlling the delivery flow rate of the fourth delivery port 302*a* of the subsidiary pump 302.

Figure 2:
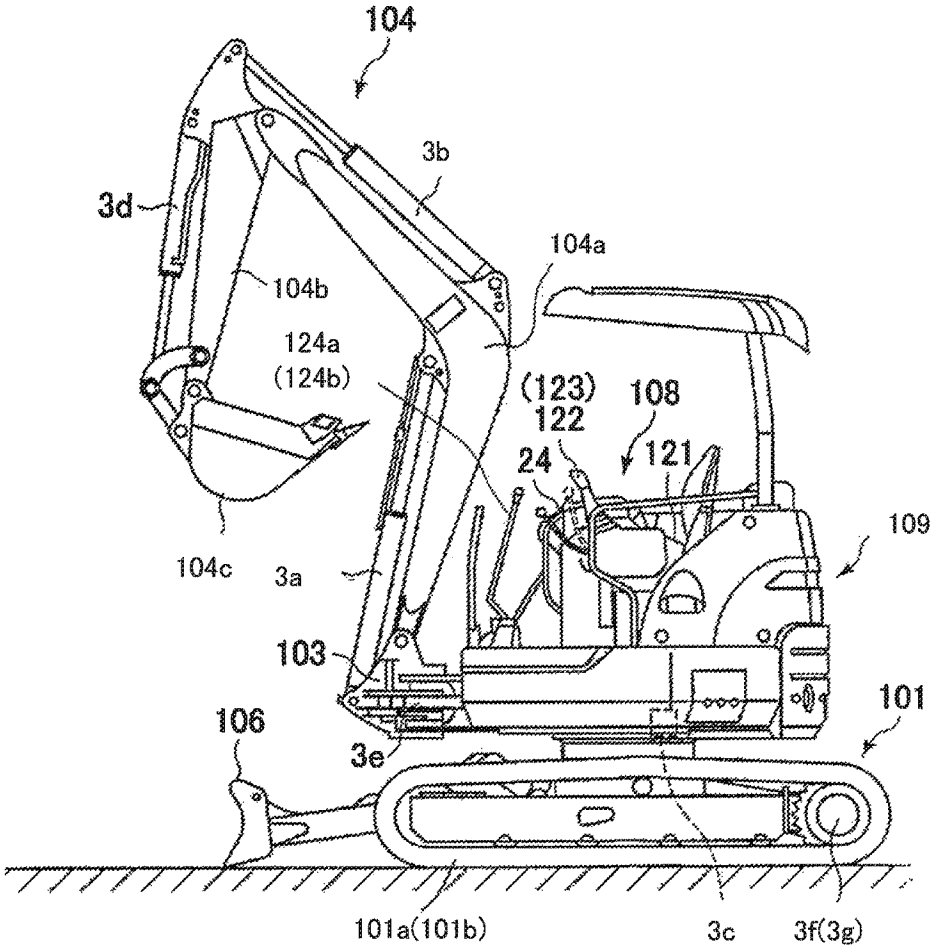
FIG. 2 is a schematic diagram showing the external appearance of a hydraulic excavator to which the present invention is applied.

The hydraulic drive system further comprises a pilot pump 30, a prime mover revolution speed detection valve 13, a pilot relief valve 32, a gate lock valve 100, and control lever units 122, 123, 124*a* and 124*b* (FIG. 2). The pilot pump 30 is a fixed displacement pump which is driven by the prime mover 1. The prime mover revolution speed detection valve 13 is connected to a hydraulic fluid supply line 31*a* of the pilot pump 30 and detects the delivery flow rate of the pilot pump 30 as absolute pressure Pgr. The pilot relief valve 32 is connected to a pilot hydraulic fluid supply line 31*b* downstream of the prime mover revolution speed detection valve 13 and generates a fixed pilot pressure in the pilot hydraulic fluid supply line 31*b*. The gate lock valve 100 is connected to the pilot hydraulic fluid supply line 31*b* and connects a hydraulic fluid supply line 31*c* downstream of the gate lock valve 100 with the pilot hydraulic fluid supply line 31*b* or a tank (switching) depending on the position of the a gate lock lever 24. The control lever units 122, 123, 124*a* and 124*b* (FIG. 2) include pilot valves (pressure-reducing valves) that are connected to the pilot hydraulic fluid supply line 31*c* downstream of the gate lock valve 100 for generating operating pilot pressures for controlling flow control valves 6*a*, 6*b*, 6*c*, 6*d*, 6*e*, 6*f*, 6*g* and 6*h* (explained later).

The actuators 3*a*-3*h* include a first actuator group (actuators 3*a*, 3*c*, 3*d* and 3*f*) including a first specific actuator 3*a* and a second actuator group (actuators 3*b*, 3*e*, 3*g* and 3*h*) including a second specific actuator 3*b*. The first and second specific actuators 3*a* and 3*b* are actuators having greater demanded flow rates than other actuators and tending to have a great load pressure difference between each other when driven at the same time. The actuators of the first actuator group other than the first specific actuator 3*a* (the actuators 3*c*, 3*d* and 3*f*) and the actuators of the second actuator group other than the second specific actuator 3*b* (the actuators 3*e*, 3*g* and 3*h*) are actuators having less demanded flow rates than the first and second specific actuators 3*a* and 3*b*. The actuators of the first actuator group other than the first specific actuator 3*a* (the actuators 3*c*, 3*d* and 3*f*) include a third specific actuator 3*f*. The actuators of the second actuator group other than the second specific actuator 3*b* (the actuators 3*e*, 3*g* and 3*h*) include a fourth specific actuator 3*g*. The third and fourth specific actuators 3*f* and 3*g* are actuators achieving a prescribed function by having supply flow rates equivalent to each other when driven at the same time.

Specifically, the first and second specific actuators 3*a* and 3*b* are a boom cylinder for driving a boom of the hydraulic excavator and an arm cylinder for driving an arm of the hydraulic excavator, for example. The actuators 3*c*, 3*d* and 3*f* of the first actuator group (having less demanded flow rates than the first and second specific actuators 3*a* and 3*b*) are a swing motor for driving a swing structure of the hydraulic excavator, a bucket cylinder for driving a bucket of the hydraulic excavator, and a left travel motor for driving a left crawler of a lower track structure of the hydraulic excavator. The actuators 3*e*, 3*g* and 3*h* of the second actuator group (having less demanded flow rates than the first and second specific actuators 3*a* and 3*b*) are a swing cylinder for driving a swing post, a right travel motor for driving a right crawler of the lower track structure, and a blade cylinder for driving a blade. The third and fourth specific actuators 3*f* and 3*g* are the left and right travel motors.

The control valve unit 4 includes the flow control valves 6*a*, 6*b*, 6*c*, 6*d*, 6*e*, 6*f*, 6*g* and 6*h*, pressure compensating valves 7*a*, 7*b*, 7*c*, 7*d*, 7*e*, 7*f*, 7*g* and 7*h*, and operation detection valves 8*a*, 8*b*, 8*c*, 8*d*, 8*e*, 8*f*, 8*g* and 8*h*. The flow control valves 6*a*-6*h* control the flow rates of the hydraulic fluid supplied to the actuators 3*a*-3*h* from the first and second delivery ports 102*a* and 102*b* of the main pump 102, the third delivery port 202*a* of the subsidiary pump 202 and the fourth delivery port 302*a* of the subsidiary pump 302. Each pressure compensating valve 7*a*-7*h* controls the differential pressure across each flow control valve 6a-6h so that the differential pressure becomes equal to a target differential pressure. Each operation detection valve 8a-8h strokes together with the spool of each flow control valve 6a-6h in order to detect the switching of each flow control valve.

The flow control valves 6a, 6c, 6d and 6f are valves for controlling the flow rates of the hydraulic fluid supplied to the actuators 3a, 3c, 3d and 3f of the first actuator group. Among the flow control valves 6a, 6c, 6d and 6f, the flow control valves 6c, 6d and 6f associated with the actuators 3c, 3d and 3f other than the first specific actuator 3a are connected to a first hydraulic fluid supply line 105 (which is connected to the first delivery port 102a of the main pump 102) via the pressure compensating valves 7c, 7d and 7f. The flow control valve 6a associated with the first specific actuator 3a is connected to a third hydraulic fluid supply line 305 (which is connected to the third delivery port 202a of the subsidiary pump 202) via the pressure compensating valve 7a.

The flow control valves 6b, 6e, 6g and 6h are valves for controlling the flow rates of the hydraulic fluid supplied to the actuators 3b, 3e, 3g and 3h of the second actuator group. Among the flow control valves 6b, 6e, 6g and 6h, the flow control valves 6e, 6g and 6h associated with the actuators 3e, 3g and 3h other than the second specific actuator 3b are connected to a second hydraulic fluid supply line 205 (which is connected to the second delivery port 102b of the main pump 102) via the pressure compensating valves 7e, 7g and 7h. The flow control valve 6b associated with the second specific actuator 3b is connected to a fourth hydraulic fluid supply line 405 (which is connected to the fourth delivery port 302a of the subsidiary pump 302) via the pressure compensating valve 7b.

The control valve unit 4 further includes main relief valves 114 and 214, unload valves 115, 215, 315 and 415, and selector valve 141, 241 and 40. The main relief valve 114 is connected to the first hydraulic fluid supply line 105 of the main pump 102 and controls the pressure in the first hydraulic fluid supply line 105 so that the pressure does not exceed a preset pressure. The main relief valve 214 is connected to the second hydraulic fluid supply line 205 of the main pump 102 and controls the pressure in the second hydraulic fluid supply line 205 so that the pressure does not exceed a preset pressure. The unload valve 115 (first unload valve) is connected to the first hydraulic fluid supply line 105 via the selector valve 141 when the boom cylinder 3a is not driven. When the pressure in the first hydraulic fluid supply line 105 becomes higher by a prescribed pressure (which is set by a spring) than the maximum load pressure of the actuators 3c, 3d and 3f of the first actuator group other than the boom cylinder 3a, the unload valve 115 shifts to the open state and returns the hydraulic fluid in the first hydraulic fluid supply line 105 to the tank. The unload valve 215 (third unload valve) is connected to the second hydraulic fluid supply line 205 via the selector valve 241 when the arm cylinder 3b is not driven. When the pressure in the second hydraulic fluid supply line 205 becomes higher by a prescribed pressure (which is set by a spring) than the maximum load pressure of the actuators 3e, 3g and 3h of the second actuator group other than the arm cylinder 3b, the unload valve 215 shifts to the open state and returns the hydraulic fluid in the second hydraulic fluid supply line 205 to the tank. The unload valve 315 (second unload valve) is connected to the third hydraulic fluid supply line 305. At times of driving the boom cylinder 3a, when the pressure in the third hydraulic fluid supply line 305 becomes a prescribed pressure or more higher than the maximum load pressure of the actuators 3a, 3c, 3d and 3f of the first actuator group, the unload valve 315 shifts to the open state and returns the hydraulic fluid in the third hydraulic fluid supply line 305 to the tank. Also when an actuator 3c, 3d or 3f of the first actuator group other than the boom cylinder 3a is driven at times of not driving the boom cylinder 3a, the unload valve 315 shifts to the open state and returns the hydraulic fluid in the third hydraulic fluid supply line 305 to the tank when the pressure in the third hydraulic fluid supply line 305 becomes higher by the prescribed pressure (which is set by a spring) than the tank pressure. The unload valve 415 (fourth unload valve) is connected to the fourth hydraulic fluid supply line 405. At times of driving the arm cylinder 3b, when the pressure in the fourth hydraulic fluid supply line 405 becomes higher by a prescribed pressure than the maximum load pressure of the actuators 3b, 3g, 3e and 3h of the second actuator group, the unload valve 415 shifts to the open state and returns the hydraulic fluid in the fourth hydraulic fluid supply line 405 to the tank. Also when an actuator 3e, 3g or 3h of the second actuator group other than the arm cylinder 3b is driven at times of not driving the arm cylinder 3b, the unload valve 415 shifts to the open state and returns the hydraulic fluid in the fourth hydraulic fluid supply line 405 to the tank when the pressure in the fourth hydraulic fluid supply line 405 becomes higher by the prescribed pressure (which is set by a spring) than the tank pressure. The selector valve 141 (first selector valve) is positioned at a first position (lower position in FIG. 1) when the boom cylinder 3a is not driven. At the first position, the selector valve 141 interrupts communication between the first hydraulic fluid supply line 105 of the main pump 102 and the third hydraulic fluid supply line 305 of the subsidiary pump 202 and connects the first hydraulic fluid supply line 105 of the main pump 102 to the unload valve 115. When the boom cylinder 3a is driven, the selector valve 141 switches to a second position (upper position in FIG. 1). At the second position, the selector valve 141 establishes communication between the first hydraulic fluid supply line 105 of the main pump 102 and the third hydraulic fluid supply line 305 of the subsidiary pump 202 and interrupts communication between the first hydraulic fluid supply line 105 of the main pump 102 and the unload valve 115. The selector valve 241 (second selector valve) is positioned at a first position (lower position in FIG. 1) when the arm cylinder 3b is not driven. At the first position, the selector valve 241 interrupts communication between the second hydraulic fluid supply line 205 of the main pump 102 and the fourth hydraulic fluid supply line 405 of the subsidiary pump 302 and connects the second hydraulic fluid supply line 205 of the main pump 102 to the unload valve 215. When the arm cylinder 3b is driven, the selector valve 241 switches to a second position (upper position in FIG. 1). At the second position, the selector valve 241 establishes communication between the second hydraulic fluid supply line 205 of the main pump 102 and the fourth hydraulic fluid supply line 405 of the subsidiary pump 302 and interrupts communication between the second hydraulic fluid supply line 205 of the main pump 102 and the unload valve 215. The selector valve 40 (third selector valve) is positioned at a first position (interrupting position) when a travel combined operation is not performed. The travel combined operation is an operation in which the left travel motor 3f and/or the right travel motor 3g and at least one of the other actuators are driven at the same time. At the first position, the selector valve 40 interrupts communication between the first hydraulic fluid supply line 105 and the second hydraulic fluid supply line 205. When the travel combined operation is performed, the selector valve 40 switches to a second position (communicating position) and establishes communication between the first hydraulic fluid supply line 105 and the second hydraulic fluid supply line 205.

The control valve unit 4 further includes shuttle valves 9*c*, 9*d*, 9*e*, 9*f*, 9*g*, 9*h*, 9*i* and 9*j* and selector valves 145, 146, 245 and 246. The shuttle valves 9*c*, 9*d* and 9*f* are connected to load detection ports of the flow control valves 6*a*, 6*c*, 6*d* and 6*f* associated with the actuators 3*a*, 3*c*, 3*d* and 3*f* connected to the first and third hydraulic fluid supply lines 105 and 305 and detect the maximum load pressure Plmax1 of the actuators 3*a*, 3*c*, 3*d* and 3*f*. The shuttle valves 9*e*, 9*g* and 9*h* are connected to load detection ports of the flow control valves 6*b*, 6*e*, 6*g* and 6*h* associated with the actuators 3*b*, 3*e*, 3*g* and 3*h* connected to the second and fourth hydraulic fluid supply lines 205 and 405 and detect the maximum load pressure Plmax2 of the actuators 3*b*, 3*e*, 3*g* and 3*h*. The selector valve 145 is positioned at a first position (lower position in FIG. 1) when the boom cylinder 3*a* is not driven. At the first position, the selector valve 145 leads the tank pressure to the unload valve 315 which is connected to the third hydraulic fluid supply line 305 and to a differential pressure reducing valve 311 which will be explained later. When the boom cylinder 3*a* is driven, the selector valve 145 switches to a second position (upper position in FIG. 1) and leads the maximum load pressure Plmax1 of the actuators 3*a*, 3*c*, 3*d* and 3*f* to the unload valve 315 and the differential pressure reducing valve 311. The selector valve 245 is positioned at a first position (lower position in FIG. 1) when the arm cylinder 3*b* is not driven. At the first position, the selector valve 245 leads the tank pressure to the unload valve 415 which is connected to the fourth hydraulic fluid supply line 405 and to a differential pressure reducing valve 411 which will be explained later. When the arm cylinder 3*b* is driven, the selector valve 245 switches to a second position (upper position in FIG. 1) and leads the maximum load pressure Plmax2 of the actuators 3*b*, 3*e*, 3*g* and 3*h* to the unload valve 415 and the differential pressure reducing valve 411. The selector valve 146 is positioned at a first position (lower position in FIG. 1) when the travel combined operation (driving the left travel motor 3*f* and/or the right travel motor 3*g* and at least one of the other actuators at the same time) is not performed. At the first position, the selector valve 146 outputs the tank pressure. When the travel combined operation is performed, the selector valve 146 switches to a second position (upper position in FIG. 1) and outputs the maximum load pressure Plmax1 of the actuators 3*a*, 3*c*, 3*d* and 3*f* connected to the first and third hydraulic fluid supply lines 105 and 305. The shuttle valve 9*j* detects the higher pressure from the output pressure of the selector valve 146 and the load pressure of the right travel motor 3*g* and leads the detected higher pressure to the shuttle valve 9*g*. The selector valve 246 is positioned at a first position (lower position in FIG. 1) when the travel combined operation is not performed. At the first position, the selector valve 246 outputs the tank pressure. When the travel combined operation is performed, the selector valve 246 switches to a second position (upper position in FIG. 1) and outputs the maximum load pressure Plmax2 of the actuators 3*b*, 3*e*, 3*g* and 3*h* connected to the hydraulic fluid supply lines 205 and 405. The shuttle valve 9*i* detects the higher pressure from the output pressure of the selector valve 246 and the load pressure of the left travel motor 3*f* and leads the detected higher pressure to the shuttle valve 9*f*.

The control valve unit 4 further includes a boom operation detection hydraulic line 52, an arm operation detection hydraulic line 54, a travel combined operation detection hydraulic line 53, and differential pressure reducing valves 111, 211, 311 and 411. The boom operation detection hydraulic line 52 is a hydraulic line whose upstream side is connected to the pilot hydraulic fluid supply line 31*b* via a restrictor 42 and whose downstream side is connected to the tank via the operation detection valve 8*a*. When the boom cylinder 3*a* is driven, the communication of the boom operation detection hydraulic line 52 to the tank is interrupted by the operation detection valve 8*a* stroking together with the flow control valve 6*a*, and thus the pressure generated by the pilot relief valve 32 is led to the selector valves 141, 145 and 146 as operation detection pressure, by which the selector valves 141, 145 and 146 are pushed downward in FIG. 1 and switched to the second positions. When the boom cylinder 3*a* is not driven, the boom operation detection hydraulic line 52 is connected to the tank via the operation detection valve 8*a*, by which the operation detection pressure becomes equal to the tank pressure and the selector valves 141, 145 and 146 are switched to the first positions (lower positions in FIG. 1). The arm operation detection hydraulic line 54 is a hydraulic line whose upstream side is connected to the pilot hydraulic fluid supply line 31*b* via a restrictor 44 and whose downstream side is connected to the tank via the operation detection valve 8*b*. When the arm cylinder 3*b* is driven, the communication of the arm operation detection hydraulic line 54 to the tank is interrupted by the operation detection valve 8*b* stroking together with the flow control valve 6*b*, and thus the pressure generated by the pilot relief valve 32 is led to the selector valves 241, 245 and 246 as operation detection pressure, by which the selector valves 241, 245 and 246 are pushed downward in FIG. 1 and switched to the second positions. When the arm cylinder 3*b* is not driven, the arm operation detection hydraulic line 54 is connected to the tank via the operation detection valve 8*b*, by which the operation detection pressure becomes equal to the tank pressure and the selector valves 241, 245 and 246 are switched to the first positions (lower positions in FIG. 1). The travel combined operation detection hydraulic line 53 is a hydraulic line whose upstream side is connected to the pilot hydraulic fluid supply line 31*b* via a restrictor 43 and whose downstream side is connected to the tank via the operation detection valves 8*a*, 8*b*, 8*c*, 8*d*, 8*e*, 8*f*, 8*g* and 8*h*. When the travel combined operation (driving the left travel motor 3*f* and/or the right travel motor 3*g* and at least one of the other actuators at the same time) is performed, the communication of the travel combined operation detection hydraulic line 53 to the tank is interrupted by the operation detection valve 8*f* and/or the operation detection valve 8*g* and at least one of the operation detection valves 8*a*, 8*b*, 8*c*, 8*d*, 8*e* and 8*h* stroking together with associated flow control valves, and thus the pressure generated by the pilot relief valve 32 is led to the selector valve 40 as operation detection pressure, by which the selector valve 40 is pushed downward in FIG. 1 and switched to the second position (communicating position). When the travel combined operation is not performed, the travel combined operation detection hydraulic line 53 is connected to the tank via the operation detection valve 8*f* and/or the operation detection valve 8*g* and the operation detection valves 8*a*, 8*b*, 8*c*, 8*d*, 8*e* and 8*h*, by which the operation detection pressure becomes equal to the tank pressure and the selector valve 40 is switched to the first position as the lower positions in FIG. 1 (interrupting position). The differential pressure reducing valve 111 outputs the difference between the pressure in the first hydraulic fluid supply line 105 of the main pump 102 (i.e., pump pressure P1) and the maximum load pressure Plmax1 of the actuators 3*a*, 3*c*, 3*d* and 3*f* connected to the first and third hydraulic fluid supply lines 105 and 305 (LS differential pressure) as absolute pressure Pls1. The differential pressure reducing valve 211 outputs the difference between the pressure in the second hydraulic fluid supply line 205 of the main pump 102 (i.e., pump pressure P2) and the maximum load pressure Plmax2 of the actuators 3*b*, 3*e*, 3*g* and 3*h* connected to the second and fourth hydraulic fluid supply lines 205 and 405 (LS differential pressure) as absolute pressure Pls2. The differential pressure reducing valve 311 outputs the difference between the pressure in the third hydraulic fluid supply line 305 of the subsidiary pump 202 (i.e., pump pressure P3 (=pump pressure P1)) and the maximum load pressure Plmax3 of the actuators 3*a*, 3*c*, 3*d* and 3*f* (LS differential pressure) as absolute pressure Pls3 when the boom cylinder 3*a* is driven. When the boom cylinder 3*a* is not driven, the differential pressure reducing valve 311 outputs the pressure in the third hydraulic fluid supply line 305 (=pressure equivalent to the prescribed pressure set by the spring of the unload valve 315) as the absolute pressure Pls3. The differential pressure reducing valve 411 outputs the difference between the pressure in the fourth hydraulic fluid supply line 405 of the subsidiary pump 302 (i.e., pump pressure P4 (=pump pressure P2)) and the maximum load pressure Plmax4 of the actuators 3*b*, 3*e*, 3*g* and 3*h* (LS differential pressure) as absolute pressure Pls4 when the arm cylinder 3*b* is driven. When the arm cylinder 3*b* is not driven, the differential pressure reducing valve 411 outputs the pressure in the fourth hydraulic fluid supply line 405 (=pressure equivalent to the prescribed pressure set by the spring of the unload valve 415) as the absolute pressure Pls3.

The prime mover revolution speed detection valve 13 includes a flow rate detection valve 50 which is connected between the hydraulic fluid supply line 31*a* of the pilot pump 30 and the pilot hydraulic fluid supply line 31*b* and a differential pressure reducing valve 51 which outputs the differential pressure across the flow rate detection valve 50 as absolute pressure Pgr.

The flow rate detection valve 50 includes a variable restrictor part 50*a* whose opening area increases with the increase in the flow rate through itself (delivery flow rate of the pilot pump 30). The hydraulic fluid delivered from the pilot pump 30 passes through the variable restrictor part 50*a* of the flow rate detection valve 50 and then flows to the pilot hydraulic line 31*b*'s side. At this time, a differential pressure increasing with the increase in the flow rate occurs across the variable restrictor part 50*a* of the flow rate detection valve 50. The differential pressure reducing valve 51 outputs the differential pressure across the variable restrictor part 50*a* as the absolute pressure Pgr. Since the delivery flow rate of the pilot pump 30 changes according to the revolution speed of the engine 1, the delivery flow rate of the pilot pump 30 and the revolution speed of the engine 1 can be detected by the detection of the differential pressure across the variable restrictor part 50*a*.

The regulator 112 of the main pump 102 includes a low-pressure selection valve 112*a*, an LS control valve 112*b*, and tilting control pistons 112*c*, 112*d*, 112*e* and 112*f*. The low-pressure selection valve 112*a* selects the lower pressure from the LS differential pressure outputted by the differential pressure reducing valve 111 (absolute pressure Pls1) and the LS differential pressure outputted by the differential pressure reducing valve 211 (absolute pressure Pls2). The LS control valve 112*b* operates according to differential pressure between the selected lower LS differential pressure and the output pressure (absolute pressure) Pgr of the prime mover revolution speed detection valve 13. When the LS differential pressure is higher than the output pressure (absolute pressure) Pgr, the LS control valve 112*b* increases the output pressure by connecting its input side to the pilot hydraulic fluid supply line 31*b*. When the LS differential pressure is lower than the output pressure (absolute pressure) Pgr, the LS control valve 112*b* decreases the output pressure by connecting its input side to the tank. The tilting control piston 112*c* is a piston for LS control which is supplied with the output pressure of the LS control valve 112*b* and operates in the direction of decreasing the tilting (displacement) of the main pump 102 with the increase in the output pressure. The tilting control pistons 112*e* and 112*d* are pistons for torque control (power control) which respectively operate in the direction of decreasing the tilting (displacement) of the main pump 102 according to the pressures in the first and second hydraulic fluid supply lines 105 and 205 of the main pump 102. The tilting control piston 112*f* is a piston for total torque control (total power control) which operates in the direction of decreasing the tilting (displacement) of the main pump 102 according to the output pressure of a pressure reducing valve 112*g* to which the pressure of the third hydraulic fluid supply line 305 of the subsidiary pump 202 and the pressure of the fourth hydraulic fluid supply line 405 of the subsidiary pump 302 are led via restrictors 112*h* and 112*i*, respectively.

The regulator 212 of the subsidiary pump 202 includes an LS control valve 212*a* and tilting control pistons 212*c* and 212*d*. The LS control valve 212*a* operates according to differential pressure between the LS differential pressure (absolute pressure Pls3 outputted by the differential pressure reducing valve 311 and the output pressure (absolute pressure) Pgr of the prime mover revolution speed detection valve 13. When the LS differential pressure is higher than the output pressure (absolute pressure) Pgr, the LS control valve 212*a* increases the output pressure by connecting its input side to the pilot hydraulic fluid supply line 31*b*. When the LS differential pressure is lower than the output pressure (absolute pressure) Pgr, the LS control valve 212*a* decreases the output pressure by connecting its input side to the tank. The tilting control piston 212*c* is a piston for the LS control which is supplied with the output pressure of the LS control valve 212*a* and operates in the direction of decreasing the tilting (displacement) of the subsidiary pump 202 with the increase in the output pressure. The tilting control piston 212*d* is a piston for the torque control (power control) which operates in the direction of decreasing the tilting (displacement) of the subsidiary pump 202 according to the pressure in the third hydraulic fluid supply line 305 of the subsidiary pump 202.

The regulator 312 of the subsidiary pump 302 includes an LS control valve 312*a* and tilting control pistons 312*c* and 312*d*. The LS control valve 312*a* operates according to differential pressure between the LS differential pressure (absolute pressure Pls4 outputted by the differential pressure reducing valve 411 and the output pressure (absolute pressure) Pgr of the prime mover revolution speed detection valve 13. When the LS differential pressure is higher than the output pressure (absolute pressure) Pgr, the LS control valve 312*a* increases the output pressure by connecting its input side to the pilot hydraulic fluid supply line 31*b*. When the LS differential pressure is lower than the output pressure (absolute pressure) Pgr, the LS control valve 312*a* decreases the output pressure by connecting its input side to the tank. The tilting control piston 312*c* is a piston for the LS control which is supplied with the output pressure of the LS control valve 312*a* and operates in the direction of decreasing the tilting (displacement) of the subsidiary pump 302 with the increase in the output pressure. The tilting control piston 312*d* is a piston for the torque control (power control) which operates in the direction of decreasing the tilting (displacement) of the subsidiary pump 302 according to the pressure in the fourth hydraulic fluid supply line 405 of the subsidiary pump 302.

The low-pressure selection valve 112*a*, the LS control valve 112*b* and the tilting control piston 112*c* of the regulator 112 (first pump control unit) constitute a first load sensing control unit which controls the displacement of the main pump 102 (first pump device) so that the delivery pressures of the first and second delivery ports 102*a* and 102*b* become higher by a target differential pressure than the maximum load pressure of the actuators driven by the hydraulic fluid delivered from the first and second delivery ports 102*a* and 102*b*. The LS control valve 212*a* and the tilting control piston 212*c* of the regulator 212 (second pump control unit) constitute a second load sensing control unit which controls the displacement of the subsidiary pump 202 (second pump device) so that the delivery pressure of the third delivery port 202*a* becomes higher by a target differential pressure than the maximum load pressure of the actuators driven by the hydraulic fluid delivered from the third delivery port 202*a*. The LS control valve 312*a* and the tilting control piston 312*c* of the regulator 312 (third pump control unit) constitute a third load sensing control unit which controls the displacement of the subsidiary pump 302 (third pump device) so that the delivery pressure of the fourth delivery port 302*a* becomes higher by a target differential pressure than the maximum load pressure of the actuators driven by the hydraulic fluid delivered from the fourth delivery port 302*a*.

The tilting control pistons 112*d* and 112*e*, the restrictors 112*h* and 112*i*, the pressure reducing valve 112*g* and the tilting control piston 112*f* of the regulator 112 (first pump control unit) constitute a torque control unit which decreases the displacement of the main pump 102 (first pump device) with the increase in the average pressure of the delivery pressures of the first and second delivery ports 102*a* and 102*b* and decreases the displacement of the main pump 102 (first pump device) with the increase in the average pressure of the delivery pressures of the third and fourth delivery ports 202*a* and 302*a*. The tilting control piston 212*d* of the regulator 212 (second pump control unit) constitutes a torque control unit which decreases the displacement of the subsidiary pump 202 (second pump device) with the increase in the delivery pressure of the third delivery port 202*a*. The tilting control piston 312*d* of the regulator 312 (third pump control unit) constitutes a torque control unit which decreases the displacement of the subsidiary pump 302 (third pump device) with the increase in the delivery pressure of the fourth delivery port 302*a*.

The pilot pump 30, the prime mover revolution speed detection valve 13, the pilot relief valve 32, the operation detection valves 8*a*-8*h*, the shuttle valves 9*c*-9*j*, the selector valves 145, 146, 245 and 246, the boom operation detection hydraulic line 52, the arm operation detection hydraulic line 54, the travel combined operation detection hydraulic line 53 and the differential pressure reducing valves 111, 211, 311 and 411 constitute a control pressure generation circuit which generates pressure for controlling hydraulic elements such as the pressure compensating valves 7*a*-7*h*, the unload valves 115, 215, 315 and 415, the selector valves 141, 241 and 40, the regulator 112 (first pump control unit), the regulator 212 (second pump control unit) and the regulator 312 (third pump control unit).

FIG. 2 is a schematic diagram showing the external appearance of the hydraulic excavator in which the hydraulic drive system explained above is installed.

Referring to FIG. 2, the hydraulic excavator (well known as an example of a work machine) comprises a lower track structure 101, an upper swing structure 109, and a front work implement 104 of the swinging type. The front work implement 104 is made up of a boom 104*a*, an arm 104*b* and a bucket 104*c*. The upper swing structure 109 can be rotated (swung) with respect to the lower track structure 101 by a swing motor 3*c*. A swing post 103 is attached to the front of the upper swing structure 109. The front work implement 104 is attached to the swing post 103 to be movable vertically. The swing post 103 can be rotated (swung) horizontally with respect to the upper swing structure 109 by the expansion and contraction of the swing cylinder 3*e*. The boom 104*a*, the arm 104*b* and the bucket 104*c* of the front work implement 104 can be rotated vertically by the expansion and contraction of the boom cylinder 3*a*, the arm cylinder 3*b* and the bucket cylinder 3*d*, respectively. A blade 106 which is moved vertically by the expansion and contraction of the blade cylinder 3*h* (see FIG. 1) is attached to a center frame of the lower track structure 101. The lower track structure 101 carries out the traveling of the hydraulic excavator by driving left and right crawlers 101*a* and 101*b* by the rotation of the travel motors 3*f* and 3*g*.

The upper swing structure 109 is provided with a cab 108 of the canopy type. Arranged in the cab 108 are a cab seat 121, the left and right front/swing control lever units 122 and 123 (only the left side is shown in FIG. 2), the travel control lever units 124*a* and 124*b*, a swing control lever unit (unshown), a blade control lever unit (unshown), the gate lock lever 24, and so forth. The control lever of each of the control lever units 122 and 123 can be operated in any direction with reference to the cross-hair directions from its neutral position. When the control lever of the left control lever unit 122 is operated in the longitudinal direction, the control lever unit 122 functions as a control lever unit for the swinging. When the control lever of the left control lever unit 122 is operated in the transverse direction, the control lever unit 122 functions as a control lever unit for the arm. When the control lever of the right control lever unit 123 is operated in the longitudinal direction, the control lever unit 123 functions as a control lever unit for the boom. When the control lever of the right control lever unit 123 is operated in the transverse direction, the control lever unit 123 functions as a control lever unit for the bucket.

Operation

The operation of this embodiment will be explained below by referring to FIG. 1.

First, the hydraulic fluid delivered from the fixed displacement pilot pump 30 driven by the prime mover 1 is supplied to the hydraulic fluid supply line 31*a*. The hydraulic fluid supply line 31*a* has the prime mover revolution speed detection valve 13. The prime mover revolution speed detection valve 13 uses the flow rate detection valve 50 and the differential pressure reducing valve 51 and thereby outputs the differential pressure across the flow rate detection valve 50 (which changes according to the delivery flow rate of the pilot pump 30) as the absolute pressure Pgr. The pilot relief valve 32 connected downstream of the prime mover revolution speed detection valve 13 generates a fixed pressure in the pilot hydraulic fluid supply line 31*b*.

(a) When all Control Levers are at Neutral Positions

All the flow control valves 6*a*-6*h* are positioned at their neutral positions since all the control levers are at their neutral positions. The operation detection valves 8*a* and 8*b* are also positioned at their neutral positions since the flow control valves 6*a* and 6*b* are at their neutral positions.

The pilot hydraulic fluid in the pilot hydraulic fluid supply line 31*b* is discharged to the tank via the restrictors 42 and 44 and the operation detection valves 8*a* and 8*b* at the neutral positions. Therefore, the pressures in the boom operation detection hydraulic line 52 and the arm operation detection hydraulic line 54 situated downstream of the restrictors 42 and 44 become equal to the tank pressure, and the pressures led to the selector valves 141, 241, 145 and 245 also become equal to the tank pressure. Each of the selector valves 141, 241, 145 and 245 is pushed upward in FIG. 1 by a spring and held at the first position. The hydraulic fluid supplied from the first delivery port 102*a* of the main pump 102 to the first hydraulic fluid supply line 105 is led to the unload valve 115 via the selector valve 141. The hydraulic fluid supplied from the second delivery port 102*b* of the main pump 102 to the second hydraulic fluid supply line 205 is led to the unload valve 215 via the selector valve 241.

The pilot hydraulic fluid in the pilot hydraulic fluid supply line 31*b* is discharged to the tank via the restrictor 43 and the operation detection valves 8*f*, 8*g*, 8*b*, 8*h*, 8*e*, 8*d*, 8*c* and 8*a* at the neutral positions. Therefore, the pressure in the travel combined operation detection hydraulic line 53 situated downstream of the restrictor 43 becomes equal to the tank pressure, and the pressures led to the selector valves 40, 146 and 246 also become equal to the tank pressure. Each of the selector valves 40, 146 and 246 is pushed upward in FIG. 1 by the function of the spring and held at the first position.

By the selector valves 146 and 246, the tank pressure is led to hydraulic lines downstream of the shuttle valves 9*f* and 9*g* via the shuttle valves 9*i* and 9*j*.

The unload valve 115 is supplied with the maximum load pressure Plmax1 of the actuators 3*a*, 3*c*, 3*d* and 3*f* via the shuttle valves 9*c*, 9*d* and 9*f*. The unload valve 215 is supplied with the maximum load pressure Plmax2 of the actuators 3*b*, 3*h*, 3*e* and 3*g* via the shuttle valves 9*e*, 9*g* and 9*h*.

When all the flow control valves 6*a*-6*h* are at their neutral positions, their load detection ports are connected to the tank. In this case, the shuttle valves 9*c*, 9*d* and 9*f* and the shuttle valves 9*e*, 9*g* and 9*h* detect the tank pressure as the maximum load pressure Plmax1 and the maximum load pressure Plmax2, respectively, and thus both of Plmax1 and Plmax2 are equal to the tank pressure. Accordingly, the pressures P1 and P2 in the first and second hydraulic fluid supply lines 105 and 205 are kept by the unload valves 115 and 215 at a prescribed pressure (spring-set pressure) Pun0 that is set by the spring of each unload valve 115, 215 (P1=Pun0, P2=Pun0). The spring-set pressure Pun0 is generally set slightly higher than the output pressure Pgr of the prime mover revolution speed detection valve 13 (Pun0>Pgr).

The differential pressure reducing valve 111 outputs the differential pressure between the pressure P1 in the first hydraulic fluid supply line 105 and the maximum load pressure Plmax1 of the actuators 3*a*, 3*c*, 3*d* and 3*f* (LS differential pressure) as the absolute pressure Pls1. The differential pressure reducing valve 211 outputs the differential pressure between the pressure P2 in the second hydraulic fluid supply line 205 and the maximum load pressure Plmax2 of the actuators 3*b*, 3*h*, 3*e* and 3*g* (LS differential pressure) as the absolute pressure Pls2. When all the control levers are at the neutral positions, both of Plmax1 and Plmax2 are equal to the tank pressure as mentioned above, and thus relationships Pls1=P1−Plmax1=P1=Pun0>Pgr and Pls2=P2−Plmax2=P2=Pun0>Pgr are satisfied assuming that the tank pressure is 0. The lower pressure is selected by the low-pressure selection valve 112*a* from the LS differential pressures Pls1 and Pls2 and the selected lower pressure is led to the LS control valve 112*b*.

Since Pls1 or Pls2=Pun0>Pgr is satisfied when all the control levers are at the neutral positions, the LS control valve 112*b* is pushed leftward in FIG. 1 and switched to the right-hand position. At the right-hand position, the LS control valve 112*b* leads the fixed pilot pressure generated by the pilot relief valve 32 to the load sensing control piston 112*c*. Since the hydraulic fluid is led to the load sensing control piston 112*c*, the displacement of the main pump 102 is maintained at the minimum level.

Meanwhile, the hydraulic fluid delivered from the subsidiary pumps 202 and 302 is led to the third and fourth hydraulic fluid supply lines 305 and 405, respectively. Since the boom and arm flow control valves 6*a* and 6*b* are at the neutral positions and the operation detection valves 8*a* and 8*b* are also at the neutral positions as mentioned above, the selector valves 145 and 245 are pushed upward in FIG. 1 by the springs and held at the first positions. To the unload valves 315 and 415 connected to the third and fourth hydraulic fluid supply lines 305 and 405, the tank pressure is led as the load pressure. When all the control levers are at the neutral positions as mentioned above, the pressures P3 and P4 in the third and fourth hydraulic fluid supply lines 305 and 405 are kept by the unload valves 315 and 415 at the prescribed pressure Pun0 set by the spring of each unload valve 315, 415 (P3=Pun0, P4=Pun0). The prescribed pressure Pun0 is generally set slightly higher than the output pressure Pgr of the prime mover revolution speed detection valve (Pun0>Pgr).

The differential pressure reducing valve 311 outputs the differential pressure between the pressure P3 in the third hydraulic fluid supply line 305 and the tank pressure (LS differential pressure) as the absolute pressure Pls3. The differential pressure reducing valve 411 outputs the differential pressure between the pressure P4 in the fourth hydraulic fluid supply line 405 and the tank pressure (LS differential pressure) as the absolute pressure Pls4. When all the control levers are at the neutral positions, relationships Pls3=P3−0=P3=Pun0>Pgr and Pls4=P4−0=P4=Pun0>Pgr are satisfied. The LS differential pressures Pls3 and Pls4 are led to the LS control valves 212*a* and 312*a*.

Since Pls3 or Pls4>Pgr is satisfied when all the control levers are at the neutral positions, the LS control valves 212*a* and 312*a* are pushed leftward in FIG. 1 and switched to the right-hand positions. At the right-hand positions, the LS control valves 212*a* and 312*a* lead the fixed pilot pressure generated by the pilot relief valve 32 to the load sensing control pistons 212*c* and 312*c*. Since the hydraulic fluid is led to the load sensing control pistons 212*c* and 312*c*, the displacements of the subsidiary pumps 202 and 302 are maintained at the minimum level.

(b) When Boom Control Lever is Operated

When the boom control lever is operated in the direction of expanding the boom cylinder 3*a* (i.e., boom raising direction), for example, the flow control valve 6*a* for driving the boom cylinder 3*a* is switched upward in FIG. 1. In response to the switching of the flow control valve 6*a*, the operation detection valve 8*a* is also switched, by which the hydraulic line for leading the hydraulic fluid in the pilot hydraulic fluid supply line 31*b* to the tank via the restrictor 42 and the operation detection valve 8*a* is interrupted and the pressure in the boom operation detection hydraulic line 52 rises to the pressure in the pilot hydraulic fluid supply line 31*b*. Accordingly, the selector valves 141 and 145 are pushed downward in FIG. 1 and switched to the second positions. When the selector valve 141 is switched to the second position, the hydraulic fluid in the first hydraulic fluid supply line 105 merges with the hydraulic fluid in the third hydraulic fluid supply line 305 via the selector valve 141.

When the selector valve 145 is switched to the second position, the maximum load pressure Plmax1 of the actuators 3*a*, 3*c*, 3*d* and 3*f* is led to the unload valve 315 and the differential pressure reducing valve 311. In the single operation of the boom cylinder 3*a*, the load pressure of the boom cylinder 3*a* is led in the direction of closing the unload valve 315 via the internal channel and the load detection port of the flow control valve 6*a*, the shuttle valve 9*c* and the selector valve 145. Accordingly, the set pressure of the unload valve 315 rises to the load pressure of the boom cylinder 3*a* plus spring force and the hydraulic line for discharging the hydraulic fluid in the third hydraulic fluid supply line 305 to the tank is interrupted. Consequently, the merged hydraulic fluid from the first hydraulic fluid supply line 105 and the third hydraulic fluid supply line 305 is supplied to the boom cylinder 3*a* via the pressure compensating valve 7*a* and the flow control valve 6*a*.

Meanwhile, the load pressure of the boom cylinder 3*a* is led also to the differential pressure reducing valve 111 via the internal channel and the load detection port of the flow control valve 6*a* and the shuttle valve 9*c*, and to the differential pressure reducing valve 311 via the internal channel and the load detection port of the flow control valve 6*a*, the shuttle valve 9*c* and the selector valve 145.

The differential pressure reducing valve 111 outputs the differential pressure between the pressure in the first hydraulic fluid supply line 105 and the load pressure of the boom cylinder 3*a* (LS differential pressure) as the absolute pressure Pls1. The pressure Pls1 is led to the left end face (in FIG. 1) of the low-pressure selection valve 112*a* in the regulator 112 of the main pump 102.

The pressure Pls1 is approximately 0 (Pls1≅0) since the difference between the pressure in the first hydraulic fluid supply line 105 and the load pressure of the boom cylinder 3*a* becomes almost 0 just after the control lever is operated for activating the boom cylinder 3*a*.

The LS differential pressure of each actuator driven by the second hydraulic fluid supply line 205 (i.e., Pls2) acts on the right end face (in FIG. 1) of the low-pressure selection valve 112*a*. Since Pls2=P2=Pun0>Pgr holds as explained in the chapter (a), the low-pressure selection valve 112*a* outputs the pressure Pls1≅0 to the LS control valve 112*b* as the lower pressure. The LS control valve 112*b* compares the output pressure Pgr of the prime mover revolution speed detection valve 13 (target LS differential pressure) with the pressure Pls1. Since the relationship Pls1≅0<Pgr holds just after the control lever is operated at the start of the boom raising, the LS control valve 112*b* performs the control so as to discharge the hydraulic fluid in the load sensing control piston 112*c* to the tank. As the hydraulic fluid in the load sensing control piston 112*c* is discharged to the tank, the main pump 102 increases its displacement. The increase in the displacement continues until Pls1=Pgr is satisfied.

Meanwhile, the differential pressure reducing valve 311 outputs the differential pressure between the pressure P3 in the third hydraulic fluid supply line 305 and the load pressure of the boom cylinder 3*a* (LS differential pressure) as the absolute pressure Pls3. The pressure Pls3 is led to the LS control valve 212*a*. The LS control valve 212*a* compares the output pressure Pgr of the prime mover revolution speed detection valve 13 (target LS differential pressure) with the pressure Pls3. Since the relationship Pls3≅0<Pgr holds just after the control lever is operated at the start of the boom raising, the LS control valve 212*a* performs the control so as to discharge the hydraulic fluid in the load sensing control piston 212*c* to the tank. As the hydraulic fluid in the load sensing control piston 212*c* is discharged to the tank, the subsidiary pump 202 increases its displacement. The increase in the displacement continues until Pls3=Pgr is satisfied.

As above, at times of the boom lever operation, the displacements of the main pump 102 and the subsidiary pump 202 are controlled appropriately by the functions of the regulators 112 and 212 of the main pump 102 and the subsidiary pump 202 so that the flow rate of the merged hydraulic fluid from the main pump 102 and the subsidiary pump 202 becomes equal to the demanded flow rate of the flow control valve 6*a*.

(c) When Arm Control Lever is Operated

When the arm control lever is operated in the direction of expanding the arm cylinder 3*b* (i.e., arm crowding direction), for example, the flow control valve 6*b* for driving the arm cylinder 3*b* is switched upward in FIG. 1. In response to the switching of the flow control valve 6*b*, the operation detection valve 8*b* is also switched, by which the hydraulic line for leading the hydraulic fluid in the pilot hydraulic fluid supply line 31*b* to the tank via the restrictor 44 and the operation detection valve 8*b* is interrupted and the pressure in the arm operation detection hydraulic line 54 rises to the pressure in the pilot hydraulic fluid supply line 31*b*. Accordingly, the selector valves 241 and 245 are pushed downward in FIG. 1 and switched to the second positions. When the selector valve 241 is switched to the second position, the hydraulic fluid in the second hydraulic fluid supply line 205 merges with the hydraulic fluid in the fourth hydraulic fluid supply line 405 via the selector valve 241.

When the selector valve 245 is switched to the second position, the maximum load pressure Plmax2 of the actuators 3*b*, 3*e*, 3*g* and 3*h* is led to the unload valve 415 and the differential pressure reducing valve 411. In the single operation of the arm cylinder 3*b*, the load pressure of the arm cylinder 3*b* is led in the direction of closing the unload valve 415 via the internal channel and the load detection port of the flow control valve 6*b*, the shuttle valve 9*h* and the selector valve 245. Accordingly, the set pressure of the unload valve 415 rises to the load pressure of the arm cylinder 3*b* plus spring force and the hydraulic line for discharging the hydraulic fluid in the fourth hydraulic fluid supply line 405 to the tank is interrupted. Consequently, the merged hydraulic fluid from the second hydraulic fluid supply line 205 and the fourth hydraulic fluid supply line 405 is supplied to the arm cylinder 3*b* via the pressure compensating valve 7*b* and the flow control valve 6*b*.

Meanwhile, the load pressure of the arm cylinder 3*b* is led also to the differential pressure reducing valve 211 via the internal channel and the load detection port of the flow control valve 6*b* and the shuttle valve 9*h*, and to the differential pressure reducing valve 411 via the internal channel and the load detection port of the flow control valve 6*b*, the shuttle valve 9*h* and the selector valve 245.

The differential pressure reducing valve 211 outputs the differential pressure between the pressure in the second hydraulic fluid supply line 205 and the load pressure of the arm cylinder 3*b* (LS differential pressure) as the absolute pressure Pls2. The pressure Pls2 is led to the right end face (in FIG. 1) of the low-pressure selection valve 112*a* in the regulator 112 of the main pump 102.

The pressure Pls2 is approximately 0 (Pls2≅0) since the difference between the pressure in the second hydraulic fluid supply line 205 and the load pressure of the arm cylinder 3*b* becomes almost 0 just after the control lever is operated for activating the arm cylinder 3*b*.

The LS differential pressure of each actuator driven by the first hydraulic fluid supply line 105 (i.e., Pls1) acts on the left end face (in FIG. 1) of the low-pressure selection valve 112*a*. Since Pls1=P1=Pun0>Pgr holds as explained in the chapter (a), the low-pressure selection valve 112*a* outputs the pressure Pls2≅0 to the LS control valve 112*b* as the lower pressure. The LS control valve 112*b* compares the output pressure Pgr of the prime mover revolution speed detection valve 13 (target LS differential pressure) with the pressure Pls2. Since the relationship Pls2≅0<Pgr holds just after the control lever is operated at the start of the arm crowding, the LS control valve 112*b* is switched so as to discharge the hydraulic fluid in the load sensing control piston 112*c* to the tank. As the hydraulic fluid in the load sensing control piston 112*c* is discharged to the tank, the main pump 102 increases its displacement. The increase in the displacement continues until Pls2=Pgr is satisfied.

Meanwhile, the differential pressure reducing valve 411 outputs the differential pressure between the pressure P4 in the fourth hydraulic fluid supply line 405 and the load pressure of the arm cylinder 3*b* (LS differential pressure) as the absolute pressure Pls4. The pressure Pls4 is led to the LS control valve 312*a*. The LS control valve 312*a* compares the output pressure Pgr of the prime mover revolution speed detection valve 13 (target LS differential pressure) with the pressure Pls4. Since the relationship Pls4≅0<Pgr holds just after the control lever is operated at the start of the arm crowding, the LS control valve 312*a* performs the control so as to discharge the hydraulic fluid in the load sensing control piston 312*c* to the tank. As the hydraulic fluid in the load sensing control piston 312*c* is discharged to the tank, the subsidiary pump 302 increases its displacement. The increase in the displacement continues until Pls4=Pgr is satisfied.

As above, at times of the arm lever operation, the displacements of the main pump 102 and the subsidiary pump 302 are controlled appropriately by the functions of the regulators 112 and 312 of the main pump 102 and the subsidiary pump 302 so that the flow rate of the merged hydraulic fluid from the main pump 102 and the subsidiary pump 302 becomes equal to the demanded flow rate of the flow control valve 6*b*.

(d) When Bucket Control Lever is Operated

When the bucket control lever is operated in the direction of expanding the bucket cylinder 3*d* (i.e., bucket crowding direction), for example, the flow control valve 6*d* for driving the bucket cylinder 3*d* is switched upward in FIG. 1. In response to the switching of the flow control valve 6*d*, the operation detection valve 8*d* is also switched. Since the operation detection valves 8*f* and 8*g* for the flow control valves 6*f* and 6*g* for driving the travel motors are at the neutral positions, the hydraulic fluid supplied from the pilot hydraulic fluid supply line 31*b* via the restrictor 43 is discharged to the tank. Accordingly, the pressure in the travel combined operation detection hydraulic line 53 becomes equal to the tank pressure. Consequently, the selector valve 40 is pushed upward in FIG. 1 by the function of the spring and held at the first position and the first and second hydraulic fluid supply lines 105 and 205 are kept in the interrupted state.

The pressure in the boom operation detection hydraulic line 52 becomes equal to the tank pressure and the selector valves 141 and 145 are pushed upward in FIG. 1 by the functions of the springs and held at the first positions since the boom control lever is not operated, the operation detection valve 8*a* is at the neutral position and the hydraulic fluid supplied from the pilot hydraulic fluid supply line 31*b* via the restrictor 42 and the operation detection valve 8*a* is discharged to the tank via the operation detection valve 8*a*. Accordingly, the first hydraulic fluid supply line 105 is connected to the unload valve 115 and the tank pressure is led to the unload valve 315 and the differential pressure reducing valve 311 as the load pressure.

Similarly, the pressure in the arm operation detection hydraulic line 54 becomes equal to the tank pressure and the selector valves 241 and 245 are pushed upward in FIG. 1 by the functions of the springs and held at the first positions since the arm control lever is not operated, the operation detection valve 8*b* is at the neutral position and the hydraulic fluid supplied from the pilot hydraulic fluid supply line 31*b* via the restrictor 44 and the operation detection valve 8*b* is discharged to the tank via the operation detection valve 8*b*. Accordingly, the second hydraulic fluid supply line 205 is connected to the unload valve 215 and the tank pressure is led to the unload valve 415 and the differential pressure reducing valve 411 as the load pressure.

The load pressure of the bucket cylinder 3*d* is led in the direction of closing the unload valve 115 via the internal channel and the detection port of the flow control valve 6*d* and the shuttle valves 9*f*, 9*d* and 9*c*. Accordingly, the set pressure of the unload valve 115 rises to the load pressure of the bucket cylinder 3*d* plus spring force and the hydraulic line for discharging the hydraulic fluid in the first hydraulic fluid supply line 105 to the tank is interrupted. Consequently, the hydraulic fluid in the first hydraulic fluid supply line 105 is supplied to the bucket cylinder 3*d* via the pressure compensating valve 7*d* and the flow control valve 6*d*.

The load pressure of the bucket cylinder 3*d* is led also to the differential pressure reducing valve 111. The differential pressure reducing valve 111 outputs the differential pressure between the pressure in the first hydraulic fluid supply line 105 and the load pressure of the bucket cylinder 3*d* (LS differential pressure) as the absolute pressure Pls1.

The pressure Pls1 is led to the left end face (in FIG. 1) of the low-pressure selection valve 112*a* in the regulator 112 of the main pump 102.

The pressure Pls1 is approximately 0 (Pls1≅0) since the difference between the pressure in the first hydraulic fluid supply line 105 and the load pressure of the bucket cylinder 3*d* becomes almost 0 just after the control lever is operated for activating the bucket cylinder 3*d*.

The LS differential pressure of each actuator driven by the second hydraulic fluid supply line 205 (i.e., Pls2) acts on the right end face (in FIG. 1) of the low-pressure selection valve 112*a*. Since Pls2=P2=Pun0>Pgr holds as explained in the chapter (a), the low-pressure selection valve 112*a* outputs the pressure Pls1≅0 to the LS control valve 112*b* as the lower pressure. The LS control valve 112*b* compares the output pressure Pgr of the prime mover revolution speed detection valve 13 (target LS differential pressure) with the pressure Pls1. Since the relationship Pls1≅0<Pgr holds just after the control lever is operated for activating the bucket cylinder 3*d*, the LS control valve 112*b* performs the control so as to discharge the hydraulic fluid in the load sensing control piston 112*c* to the tank. As the hydraulic fluid in the load sensing control piston 112*c* is discharged to the tank, the main pump 102 increases its displacement. The increase in the displacement continues until Pls1=Pgr is satisfied.

As above, at times of the bucket lever operation, the displacement of the main pump 102 is controlled appropriately by the function of the regulator 112 of the main pump 102 so that the flow rate of the hydraulic fluid delivered from the main pump 102 becomes equal to the demanded flow rate of the flow control valve 6*d*.

Meanwhile, since the flow control valve 6*a* for driving the boom cylinder 3*a* and the flow control valve 6*b* for driving the arm cylinder 3*b* are not switched, the tank pressure is led to the unload valves 315 and 415 and the differential pressure reducing valves 311 and 411 as the load pressure of each actuator. Accordingly, the hydraulic fluid in the third and fourth hydraulic fluid supply line 305 and 405 is discharged to the tank by the unload valves 315 and 415. At this time, the pressures P3 and P4 in the third and fourth hydraulic fluid supply lines 305 and 405 are maintained at the pressure Pun0 slightly higher than the pressure Pgr (target LS differential pressure) by the functions of the springs of the unload valves 315 and 415.

Meanwhile, the outputs Pls3 and Pls4 of the differential pressure reducing valves 311 and 411 satisfy Pls3=P3=Pun0>Pgr and Pls4=P4=Pun0>Pgr. The pressures Pls3 and Pls4 are led to the right end faces (in FIG. 1) of the LS control valves 212*a* and 312*a*, respectively. The output pressure Pgr of the prime mover revolution speed detection valve 13 is led to the left end faces (in FIG. 1) of the LS control valves 212*a* and 312*a*. Since the above relationships hold, the LS control valves 212*a* and 312*a* are pushed leftward in FIG. 1 and switched to the right-hand positions. At the right-hand positions, the LS control valves 212*a* and 312*a* lead the pressure in the pilot hydraulic fluid supply line 31*b* to the load sensing control pistons 212*c* and 312*c*. As the hydraulic fluid is led to the load sensing control pistons 212*c* and 312*c*, the subsidiary pumps 202 and 302 are controlled in the direction of decreasing the displacement and are maintained at the minimum displacement.

As above, at times of driving the bucket cylinder 3*d* whose demanded flow rate is low, the main pump 102 can be used at a point of higher efficiency since the bucket cylinder 3*d* can be driven by the main pump 102 alone.

(e) When Boom and Arm Control Levers are Operated at the Same Time

A case of performing the level smoothing operation (combined operation of the boom cylinder (high load, low flow rate) and the arm cylinder (low load, high flow rate)) will be explained below.

When the boom control lever is operated in the direction of expanding the boom cylinder 3*a* (i.e., boom raising direction) and the arm control lever is operated in the direction of expanding the arm cylinder 3*b* (i.e., arm crowding direction), the flow control valve 6*a* for driving the boom cylinder 3*a* is switched upward in FIG. 1 and the flow control valve 6*b* for driving the arm cylinder 3*b* is also switched upward in FIG. 1.

In response to the switching of the flow control valves 6*a* and 6*b*, the operation detection valves 8*a* and 8*b* are also switched, the hydraulic lines for leading the hydraulic fluid in the pilot hydraulic fluid supply line 31*b* to the tank via the restrictors 42 and 44 and the operation detection valves 8*a* and 8*b* are interrupted, and the pressures in the boom operation detection hydraulic line 52 and the arm operation detection hydraulic line 54 rise to the pressure in the pilot hydraulic fluid supply line 31*b*. Accordingly, the selector valves 141, 145, 241 and 245 are pushed downward in FIG. 1 and switched to the second positions. When the selector valves 141 and 241 are switched to the second positions, the hydraulic fluid in the first hydraulic fluid supply line 105 merges with the hydraulic fluid in the third hydraulic fluid supply line 305 via the selector valve 141 and the hydraulic fluid in the second hydraulic fluid supply line 205 merges with the hydraulic fluid in the fourth hydraulic fluid supply line 405 via the selector valve 241. When the selector valve 145 is switched to the second position, the maximum load pressure Plmax1 of the actuators 3*a*, 3*c*, 3*d* and 3*f* is led to the unload valve 315 and the differential pressure reducing valve 311. When the selector valve 245 is switched to the second position, the maximum load pressure Plmax2 of the actuators 3*b*, 3*e*, 3*g* and 3*h* is led to the unload valve 415 and the differential pressure reducing valve 411.

In the combined operation of the boom cylinder 3*a* and the arm cylinder 3*b*, the load pressure of the boom cylinder 3*a* is led in the direction of closing the unload valve 315 via the internal channel and the load detection port of the flow control valve 6*a*, the shuttle valve 9*c* and the selector valve 145. Accordingly, the set pressure of the unload valve 315 rises to the load pressure of the boom cylinder 3*a* plus spring force and the hydraulic line for discharging the hydraulic fluid in the third hydraulic fluid supply line 305 to the tank is interrupted. Meanwhile, the load pressure of the arm cylinder 3*b* is led in the direction of closing the unload valve 415 via the internal channel and the load detection port of the flow control valve 6*b*, the shuttle valve 9*h* and the selector valve 245. Accordingly, the set pressure of the unload valve 415 rises to the load pressure of the arm cylinder 3*b* plus spring force and the hydraulic line for discharging the hydraulic fluid in the fourth hydraulic fluid supply line 405 to the tank is interrupted. Consequently, the merged hydraulic fluid from the first hydraulic fluid supply line 105 and the third hydraulic fluid supply line 305 is supplied to the boom cylinder 3*a* via the pressure compensating valve 7*a* and the flow control valve 6*a*, and the merged hydraulic fluid from the second hydraulic fluid supply line 205 and the fourth hydraulic fluid supply line 405 is supplied to the arm cylinder 3*b* via the pressure compensating valve 7*b* and the flow control valve 6*b*.

The load pressure of the boom cylinder 3*a* is led to the differential pressure reducing valve 111 via the internal channel and the load detection port of the flow control valve 6*a* and the shuttle valve 9*c*, and also to the differential pressure reducing valve 311 via the selector valve 145. The load pressure of the arm cylinder 3*b* is led to the differential pressure reducing valve 211 via the internal channel and the load detection port of the flow control valve 6*b* and the shuttle valve 9*h*, and also to the differential pressure reducing valve 411 via the selector valve 245.

The differential pressure reducing valve 111 outputs the differential pressure between the pressure in the first hydraulic fluid supply line 105 and the load pressure of the boom cylinder 3*a* (LS differential pressure) as the absolute pressure Pls1. The pressure Pls1 is led to the left end face (in FIG. 1) of the low-pressure selection valve 112*a* in the regulator 112 of the main pump 102. The differential pressure reducing valve 211 outputs the differential pressure between the pressure in the second hydraulic fluid supply line 205 and the load pressure of the arm cylinder 3*b* (LS differential pressure) as the absolute pressure Pls2. The pressure Pls2 is led to the right end face (in FIG. 1) of the low-pressure selection valve 112*a* in the regulator 112 of the main pump 102.

The low-pressure selection valve 112*a* outputs the lower pressure selected from Pls1 and Pls2 to the LS control valve 112*b*. The LS control valve 112*b* compares the output pressure Pgr of the prime mover revolution speed detection valve 13 (target LS differential pressure) with the pressure Pls1 or Pls2. Since the relationship Pls1=Pls2≅0<Pgr holds just after the control levers are operated at the start of the boom raising and the arm crowding, the LS control valve 112*b* is switched so as to discharge the hydraulic fluid in the load sensing control piston 112*c* to the tank. As the hydraulic fluid in the load sensing control piston 112*c* is discharged to the tank, the main pump 102 increases its displacement and the delivery flow rates of the first and second delivery ports 102*a* and 102*b*.

In the level smoothing operation, Pls1>Pls2 holds since a high flow rate is generally necessary for the arm cylinder as mentioned above. Therefore, when the delivery flow rates of the first and second delivery ports 102*a* and 102*b* increase and the relationship Pls1>Pls2 is satisfied, the low-pressure selection valve 112*a* outputs the lower pressure Pls2 to the LS control valve 112*b* and increases the delivery flow rates of the first and second delivery ports 102*a* and 102*b* of the main pump 102 until Pls2=Pgr is satisfied.

The differential pressure reducing valve 311 outputs the differential pressure between the pressure in the third hydraulic fluid supply line 305 and the load pressure of the boom cylinder 3*a* (LS differential pressure) as the absolute pressure Pls3. The pressure Pls3 is led to the LS control valve 212*a*. Since the flow rate of the boom cylinder is allowed to be low in the level smoothing operation, a flow higher than that required by the boom cylinder flows from the main pump 102 into the first hydraulic fluid supply line 105, and thus the pressure Pls3 increases above the target LS differential pressure Pgr. Since Pls3>Pgr is satisfied, the LS control valve 212*a* is pushed leftward in FIG. 1 and switched to the right-hand position, by which the hydraulic fluid is led from the pilot hydraulic fluid supply line 31*b* to the load sensing control pistons 212*c* and 312*c*, the subsidiary pump 202 is controlled in the direction of decreasing the displacement, and the delivery flow rate of the subsidiary pump 202 is maintained at a low level.

From the unload valve 315, unnecessary hydraulic fluid corresponding to the difference between the flow supplied from the main pump 102 and the subsidiary pump 202 and the flow supplied to the boom cylinder (remainder) is discharged to the first and third hydraulic fluid supply lines 105 and 305.

Meanwhile, the differential pressure reducing valve 411 outputs the differential pressure between the pressure in the fourth hydraulic fluid supply line 405 and the load pressure of the arm cylinder 3*b* (LS differential pressure) as the absolute pressure Pls4. The pressure Pls4 is led to the LS control valve 312*a*. The LS control valve 312*a* compares the output pressure Pgr of the prime mover revolution speed detection valve 13 (target LS differential pressure) with the pressure Pls4, performs the control so as to discharge the hydraulic fluid in the load sensing control piston 112*c* to the tank as explained above, and increases the displacement of the subsidiary pump 302 until Pls4=Pgr is satisfied.

The pressure P1 in the first hydraulic fluid supply line 105 of the main pump 102 and the pressure P3 (=P1) in the third hydraulic fluid supply line 305 of the subsidiary pump 202 are maintained by the unload valve 315 at a pressure that is higher than the load pressure of the boom cylinder 3*a* by the pressure Pun0 set by the spring of the unload valve 315 (i.e., at a pressure that is the pressure Pun0 higher than the load pressure of the boom cylinder 3*a*). The pressure P2 in the second hydraulic fluid supply line 205 of the main pump 102 and the pressure P4 (=P2) in the fourth hydraulic fluid supply line 405 of the subsidiary pump 302 are maintained by the unload valve 415 at a pressure that is higher than the load pressure of the arm cylinder 3*b* by the pressure Pun0 set by the spring of the unload valve 415 (i.e., at a pressure that is the pressure Pun0 higher than the load pressure of the arm cylinder 3*b*).

In the level smoothing operation, P1=P3>P2=P4 holds since the boom cylinder 3*a* operates at a high load and a low flow rate and the arm cylinder 3*b* operates at a low load and a high flow rate as mentioned above.

As above, when the boom and arm control levers are operated at the same time (e.g., leveling operation), the boom cylinder of a high load pressure and the arm cylinder of a low load pressure are driven by hydraulic fluid flows supplied separately from the delivery ports 102*a* and 202*a* and the delivery ports 102*b* and 302*a*. Therefore, the delivery pressures of the delivery ports 102*b* and 302*a* on the arm cylinder 3*b*'s side (i.e., on the low load pressure actuator's side) can be controlled independently, by which the wasteful energy consumption due to the pressure loss in the pressure compensating valve 7*b* of the arm cylinder (low load pressure actuator) can be suppressed.

Further, since the delivery flow rate of the subsidiary pump 202 specifically for the boom cylinder 3*a* of a low demanded flow rate is maintained at a low level and the flow rate of the hydraulic fluid discharged from the unload valve 315 on the boom cylinder 3*a*'s side to the tank is low, the bleed-off loss of the unload valve 315 can be reduced and operation with still higher efficiency becomes possible.

The pressures P1 and P2 in the first and second hydraulic fluid supply lines 105 and 205 of the main pump 102 are led to the tilting control pistons 112*e* and 112*d* for the torque control (power control), respectively, and the power control is performed with the average pressure of the pressures P1 and P2. Meanwhile, the pressure P3 in the third hydraulic fluid supply line 305 of the subsidiary pump 202 and the pressure P4 in the fourth hydraulic fluid supply line 405 of the subsidiary pump 302 are led to the pressure reducing valve 112*g* via the restrictors 112*h* and 112*i*, respectively, and the output pressure of the pressure reducing valve 112*g* is led to the tilting control piston 112*f* for the total torque control (total power control). In this case, the pressure led to the pressure reducing valve 112*g* via the restrictors 112*h* and 112*i* is the average pressure (intermediate pressure) of the pressures P3 and P4 and the power control is performed with the average pressure of the pressures P3 and P4. As above, the torque control is performed on the main pump 102 of the split flow type not only with the average pressure of the pressures P1 and P2 but also with the average pressure of the pressures P3 and P4. Therefore, when the delivery pressure of the first delivery port 102*a* on the boom cylinder's side of the main pump 102 rises in the level smoothing operation and the total torque consumption of the main pump 102 and the subsidiary pumps 202 and 302 is about to exceed a prescribed value, the tilting control pistons 112*d*, 112*e* and 112*f* function more preferentially than the load sensing control, restrict the increase in the displacement of the main pump 102, and perform the control so that the total torque consumption of the main pump 102 and the subsidiary pumps 202 and 302 does not exceed the prescribed value. Consequently, even when the load pressure of the boom cylinder 3*a* is high, the drop in the driving speed of the arm cylinder 3*b* due to a significant decrease in the displacement of the main pump 102 can be prevented and excellent operability in the combined operation can be secured.

Incidentally, while the above explanation has been given of the level smoothing operation in which the boom cylinder 3*a* and the arm cylinder 3*b* are driven, also when the load pressure of one actuator increases significantly in a combined operation of simultaneously driving two or more actuators arbitrarily selected from the actuators 3a, 3c, 3d and 3f of the first actuator group and the actuators 3b, 3e, 3g and 3h of the second actuator group, the displacement of the main pump 102 is controlled by the torque control not only with the average pressure of the pressures P1 and P2 but also with the average pressure of the pressures P3 and P4, by which the drop in the driving speed of the actuator due to a significant decrease in the displacement of the main pump 102 can be prevented and excellent operability in the combined operation can be secured.

(f) When Left and Right Travel Control Levers are Operated

When the left and right travel control levers are operated, for example, the flow control valves 6f and 6g for driving the travel motors 3f and 3g are switched upward in FIG. 1.

In response to the switching of the flow control valves 6f and 6g, the operation detection valves 8f and 8g are also switched. However, the hydraulic fluid supplied from the pilot hydraulic fluid supply line 31b via the restrictor 43 is discharged to the tank via the operation detection valves 8b, 8h, 8e, 8d, 8c and 8a since the operation detection valves 8b, 8h, 8e, 8d, 8c and 8a for the flow control valves 6b, 6h, 6e, 6d, 6c and 6a for driving the other actuators 3b, 3h, 3e, 3d, 3c and 3a are at the neutral positions. Accordingly, the pressure in the travel combined operation detection hydraulic line 53 becomes equal to the tank pressure, the selector valves 40, 146 and 246 are pushed upward in FIG. 1 by the functions of the springs and held at the first positions, the first and second hydraulic fluid supply lines 105 and 205 are interrupted (isolated from each other), and the tank pressure is led to the shuttle valves 9j and 9i via the selector valves 146 and 246, respectively.

Meanwhile, the hydraulic fluid supplied from the pilot hydraulic fluid supply line 31b via the restrictor 42 and the operation detection valve 8a is discharged to the tank via the operation detection valve 8a. Accordingly, the pressure in the boom operation detection hydraulic line 52 becomes equal to the tank pressure and the selector valves 141 and 145 are pushed upward in FIG. 1 by the functions of the springs and held at the first positions. Therefore, the first hydraulic fluid supply line 105 is connected to the unload valve 115 and the tank pressure is led as the load pressures of the unload valve 315 and the differential pressure reducing valve 311.

The hydraulic fluid supplied from the pilot hydraulic fluid supply line 31b via the restrictor 44 and the operation detection valve 8b is discharged to the tank via the operation detection valve 8b. Accordingly, the pressure in the arm operation detection hydraulic line 54 becomes equal to the tank pressure and the selector valves 241 and 245 are pushed upward in FIG. 1 by the functions of the springs and held at the first positions. Therefore, the second hydraulic fluid supply line 205 is connected to the unload valve 215 and the tank pressure is led as the load pressures of the unload valve 415 and the differential pressure reducing valve 411.

The load pressure of the travel motor 3f is led in the direction of closing the unload valve 115 via the internal channel and the detection port of the flow control valve 6f and the shuttle valves 9f, 9d and 9c. The load pressure of the travel motor 3g is led in the direction of closing the unload valve 215 via the internal channel and the detection port of the flow control valve 6g and the shuttle valves 9g, 9e and 9h. Accordingly, the set pressure of each unload valve 115/215 rises to the load pressure of the travel motor 3f/3g plus spring force and the hydraulic lines for discharging the hydraulic fluid in the first and second hydraulic fluid supply lines 105 and 205 to the tank are interrupted. Consequently, the hydraulic fluid in the first hydraulic fluid supply line 105 is supplied to the travel motor 3f via the pressure compensating valve 7f and the flow control valve 6f, while the hydraulic fluid in the third hydraulic fluid supply line 305 is supplied to the travel motor 3g via the pressure compensating valve 7g and the flow control valve 6g.

The load pressure of the travel motor 3f is led also to the differential pressure reducing valve 111 via the internal channel and the detection port of the flow control valve 6f and the shuttle valves 9f, 9d and 9c, while the load pressure of the travel motor 3g is led also to the differential pressure reducing valve 211 via the internal channel and the detection port of the flow control valve 6g and the shuttle valves 9g, 9e and 9h. The differential pressure reducing valve 111 outputs the differential pressure between the pressure in the first hydraulic fluid supply line 105 and the load pressure of the travel motor 3f (LS differential pressure) as the absolute pressure Pls1, while the differential pressure reducing valve 211 outputs the differential pressure between the pressure in the second hydraulic fluid supply line 205 and the load pressure of the travel motor 3g (LS differential pressure) as the absolute pressure Pls2. The pressures Pls1 and Pls2 are respectively led to the left and right end faces (in FIG. 1) of the low-pressure selection valve 112a in the regulator 112 of the main pump 102.

Suppose that the load pressures of the left and right travel motors 3f and 3g are equal to each other just after the control levers are operated for activating the left and right travel motors 3f and 3g, Pls1=Pls2≅0 holds since the difference between the pressure in the first/second hydraulic fluid supply line 105/205 and the load pressure of the right/left travel motor 3g/3g becomes almost 0. The low-pressure selection valve 112a outputs Pls1=Pls2≅0 to the LS control valve 112b. The LS control valve 112b compares the output pressure Pgr of the prime mover revolution speed detection valve 13 (target LS differential pressure) with the pressure Pls1 or Pls2. Since Pls1=Pls2≅0<Pgr holds just after the control levers are operated for activating the travel motors 3f and 3g, the LS control valve 112b performs the control so as to discharge the hydraulic fluid in the load sensing control piston 112c to the tank. As the hydraulic fluid in the load sensing control piston 112c is discharged to the tank, the main pump 102 increases its displacement. The increase in the displacement continues until Pls1 or Pls2 coincides with Pgr.

As above, at times of the travel lever operation, the displacement of the main pump 102 is controlled appropriately by the function of the regulator 112 of the main pump 102 so that the flow rate of the hydraulic fluid delivered from the main pump 102 becomes equal to the demanded flow rate of the flow control valves 6f and 6g.

Meanwhile, since the flow control valve 6a for driving the boom cylinder 3a and the flow control valve 6b for driving the arm cylinder 3b are not switched, the tank pressure is led to the unload valves 315 and 415 and the differential pressure reducing valves 311 and 411 as the load pressure of each actuator. Accordingly, the hydraulic fluid in the third and fourth hydraulic fluid supply line 305 and 405 is discharged to the tank by the unload valves 315 and 415. At this time, the pressures P3 and P4 in the third and fourth hydraulic fluid supply line 305 and 405 are maintained at the pressure Pun0 slightly higher than the pressure Pgr (target LS differential pressure) by the functions of the springs of the unload valves 315 and 415.

Meanwhile, the outputs Pls3 and Pls4 of the differential pressure reducing valves 311 and 411 satisfying Pls3=P3=Pun0>Pgr and Pls4=P4=Pun0>Pgr are led to the right end faces (in FIG. 1) of the LS control valves 212a and 312*a*, respectively. The output pressure Pgr of the prime mover revolution speed detection valve 13 is led to the left end faces (in FIG. 1) of the LS control valves 212*a* and 312*a*. Since the above relationships hold, the LS control valves 212*a* and 312*a* are pushed leftward in FIG. 1 and switched to the right-hand positions. At the right-hand positions, the LS control valves 212*a* and 312*a* lead the pressure in the pilot hydraulic fluid supply line 31*b* to the load sensing control pistons 212*c* and 312*c*. As the hydraulic fluid is led to the load sensing control pistons 212*c* and 312*c*, the subsidiary pumps 202 and 302 are controlled in the direction of decreasing the displacement and are maintained at the minimum displacement.

As above, at times of the travel lever operation, the displacement of the main pump 102 is controlled appropriately so that the flow rate of the hydraulic fluid delivered from the main pump 102 becomes equal to the demanded flow rate of the flow control valves 6*f* and 6*g*. Therefore, when the left and right travel levers are operated at equal operation amounts with the intention of straight traveling, equal amounts of hydraulic fluid are supplied to the left and right travel motors from the first and second delivery ports 102*a* and 102*b* of the main pump 102, by which the straight traveling property can be secured.

Further, the main pump 102 is a pump of the split flow type, the pressures P1 and P2 in the first and second hydraulic fluid supply lines 105 and 205 of the main pump 102 are led to the tilting control pistons 112*e* and 112*d* for the torque control (power control), and the power control is performed with the average pressure of the pressures P1 and P2. Therefore, the drop in the steering speed due to a significant decrease in the displacement of the main pump 102 (when the load pressure of one travel motor increased significantly in the travel steering operation) can be prevented and an excellent steering feel can be secured.

(g) When Travel Control Levers and Boom Control Lever are Operated at the Same Time When the left and right travel control levers and the boom control lever (for the boom raising operation) are operated at the same time, for example, the flow control valves 6*f* and 6*g* for driving the travel motors 3*f* and 3*g* and the flow control valve 6*a* for driving the boom cylinder 3*a* are switched upward in FIG. 1. In response to the switching of the flow control valves 6*f* and 6*g*, the operation detection valves 8*f* and 8*g* are also switched. In response to the switching of the flow control valve 6*a*, the operation detection valve 8*a* is also switched. By the switching of the operation detection valves 8*f* and 8*g*, the hydraulic lines for leading the hydraulic fluid in the pilot hydraulic fluid supply line 31*b* to the tank via the restrictor 43 and the operation detection valves 8*a* and 8*b* are interrupted and the hydraulic line for leading the hydraulic fluid in the pilot hydraulic fluid supply line 31*b* to the tank via the restrictor 43 and the operation detection valve 8*a* is also interrupted. Accordingly, the pressure in the travel combined operation detection hydraulic line 53 becomes equal to the pressure in the pilot hydraulic fluid supply line 31*b*, the selector valves 40, 146 and 246 are pushed downward in FIG. 1 and switched to the second positions, the first and second hydraulic fluid supply lines 105 and 205 are brought into communication with each other, the maximum load pressure Plmax1 of the actuators 3*a*, 3*c*, 3*d* and 3*f* is led to the downstream side of the shuttle valve 9*g* via the shuttle valve 9*j*, and the maximum load pressure Plmax2 of the actuators 3*g*, 3*e* and 3*h* is led to the downstream side of the shuttle valve 9*f* via the shuttle valve 9*i*.

By the switching of the operation detection valve 8*a*, the hydraulic line for leading the hydraulic fluid in the pilot hydraulic fluid supply line 31*b* to the tank via the restrictor 42 and the operation detection valve 8*a* is interrupted, by which the pressure in the boom operation detection hydraulic line 52 becomes equal to the pressure in the pilot hydraulic fluid supply line 31*b* and the selector valves 141 and 145 are pushed downward in FIG. 1 and switched to the second positions. Accordingly, the first hydraulic fluid supply line 105 connects with the third hydraulic fluid supply line 305 and the maximum load pressure of the actuators 3*a*, 3*b*, 3*c*, 3*d*, 3*f*, 3*g*, 3*e* and 3*h* is led to the unload valve 315 and the differential pressure reducing valve 311.

Meanwhile, since the hydraulic fluid supplied from the pilot hydraulic fluid supply line 31*b* via the restrictor 44 and the operation detection valve 8*b* is discharged to the tank via the operation detection valve 8*b*, the pressure in the arm operation detection hydraulic line 54 becomes equal to the tank pressure and the selector valves 241 and 245 are pushed upward in FIG. 1 by the functions of the springs and held at the first positions. Accordingly, the second and fourth hydraulic fluid supply lines 205 and 405 are interrupted (isolated from each other), the second hydraulic fluid supply line 205 is connected to the unload valve 215, and the maximum load pressure of the actuators 3*a*, 3*b*, 3*c*, 3*d*, 3*f*, 3*g*, 3*e* and 3*h* is led to the unload valve 215 and the differential pressure reducing valve 211.

Further, since the tank pressure is led to the unload valve 415 and the differential pressure reducing valve 411 connected to the fourth hydraulic fluid supply line 405, the hydraulic fluid in the fourth hydraulic fluid supply line 405 is discharged to the tank by the unload valve 415. At this time, the pressure P4 in the fourth hydraulic fluid supply line 405 is maintained at the pressure Pun0 slightly higher than the pressure Pgr (target LS differential pressure) by the function of the spring of the unload valve 415. Thus, the output Pls4 of the differential pressure reducing valve 411 satisfies Pls4=P4=Pun0>Pgr.

Suppose that the load pressures of the travel motors 3*f* and 3*g* are higher than the load pressure of the boom cylinder 3*a* (e.g., the load pressures of the travel motors 3*f* and 3*g* are 10 MPa and the load pressure of the boom cylinder 3*a* is 5 MPa) when the left and right traveling and the boom raising operation are performed, the load pressures 10 MPa of the travel motors 3*f* and 3*g* (as the maximum load pressure) are led in the directions of closing the unload valves 315 and 215. Accordingly, the set pressure of each unload valve 315/215 rises to the load pressure of the travel motor 3*f*/3*g* plus spring force and the hydraulic lines for discharging the hydraulic fluid in the hydraulic fluid supply lines 105, 205 and 305 to the tank are interrupted. Consequently, the merged hydraulic fluid from the first hydraulic fluid supply line 105, the second hydraulic fluid supply line 205 and the third hydraulic fluid supply line 305 is supplied to the travel motors 3*f* and 3*g* via the pressure compensating valve 7*f*, the flow control valve 6*f*, the pressure compensating valve 7*g* and the flow control valve 6*g*, and to the boom cylinder 3*a* via the pressure compensating valve 7*a* and the flow control valve 6*a*.

Meanwhile, each differential pressure reducing valve 111/311/211 outputs the difference between the pressure P1=P2=P3 in the first/second/third hydraulic fluid supply line 105/205/305 and the maximum load pressure 10 MPa as the absolute pressure Pls1=Pls2=Pls3. The pressures Pls1 and Pls2 are respectively led to the left and right end faces (in FIG. 1) of the low-pressure selection valve 112*a* in the regulator 112 of the main pump 102. In this case, Pls1=Pls2=Pls3≅0 holds since the difference between the pressure in the first/second/third hydraulic fluid supply line 105/205/305 and the load pressure of the travel motors 3*g* and 3*g* becomes almost 0 just after the control levers are operated for activating the travel motors 3*f* and 3*g* and the boom cylinder 3*a*. The low-pressure selection valve 112*a* outputs the pressure Pls1=Pls2≅0 to the LS control valve 112*b*. The LS control valve 112*b* compares the output pressure Pgr of the prime mover revolution speed detection valve 13 (target LS differential pressure) with the pressure Pls1 or Pls2. Since Pls1=Pls2≅0<Pgr holds just after the control levers are operated for activating the travel motors 3*f* and 3*g* and the boom cylinder 3*a*, the LS control valve 112*b* performs the control so as to discharge the hydraulic fluid in the load sensing control piston 112*c* to the tank. As the hydraulic fluid in the load sensing control piston 112*c* is discharged to the tank, the main pump 102 increases its displacement. The increase in the displacement continues until Pls1 or Pls2 coincides with Pgr.

Assuming that Pgr=2 MPa, for example, when Pls1=Pls2=2 MPa is satisfied, the pressure P1/P2/P3 in the first/second/third hydraulic fluid supply line 105/205/305 is controlled to be equal to the load pressure of the travel motors 3*f* and 3*g* (10 MPa+2 MPa=12 MPa). The pressure compensating valve 7*a* connected to the boom cylinder 3*a* compensates for the difference (=12 MPa−5 MPa=7 MPa) between the pressure 12 Mpa in the third hydraulic fluid supply line 305 and the load pressure 5 MPa of the boom cylinder 3*a* (pressure compensation) by controlling its own opening (aperture).

Meanwhile, in the regulator 212 of the subsidiary pump 202, the aforementioned pressure Pls3≅0 is led to the right end face (in FIG. 1) of an LS control valve 212*b*. The LS control valve 212*b* compares the output Pgr of the prime mover revolution speed detection valve 13 (target LS differential pressure) with the pressure Pls3. Since the relationship Pls3≅0<Pgr is satisfied, the LS control valve 212*b* performs the control so as to discharge the hydraulic fluid in the load sensing control piston 212*c* to the tank. As the hydraulic fluid in the load sensing control piston 212*c* is discharged to the tank, the subsidiary pump 202 increases its displacement. The increase in the displacement continues until Pls3=Pgr is satisfied.

As explained above, the displacements of the main pump 102 and the subsidiary pump 202 are controlled appropriately by the functions of the regulator 112 of the main pump 102 and the regulator 212 of the subsidiary pump 202 so that the flow rate of the hydraulic fluid delivered from the main pump 102 and the subsidiary pump 202 becomes equal to the sum total of the demanded flow rates of the flow control valves 6*a*, 6*f* and 6*g*.

As above, in the combined operation of the traveling and the boom, three delivery ports (the first and second delivery ports 102*a* and 102*b* of the main pump 102 and the third delivery port 202*a* of the subsidiary pump 202) function as one delivery port and the flows of the hydraulic fluid from the three delivery ports are merged together and supplied to the left and right travel motors and the boom cylinder. Therefore, equal amounts of hydraulic fluid can be supplied to the left and right travel motors by operating the control levers of the left and right travel motors at equal input amounts (operation amounts). This makes it possible to drive the boom cylinder while maintaining the straight traveling property and to achieve excellent travel combined operation.

While the above explanation has been given of the combined operation of the traveling and the boom, excellent travel combined operation can be achieved similarly also in the combined operation of the traveling and the arm. In other combined operations in which the travel actuators and an actuator (other actuator) not for the boom or the arm are driven, the two delivery ports 102*a* and 102*b* of the main pump 102 function as one delivery port and the flows of the hydraulic fluid from the two delivery ports are merged together and supplied to the left and right travel motors and the other actuator. Also in such cases, it is possible to drive the other actuator while maintaining the straight traveling property and to achieve excellent travel combined operation.

Effects

As described above, the following effects can be achieved by this embodiment:

(1) When the boom and arm control levers are operated at the same time (e.g., leveling operation), the boom cylinder of a high load pressure and the arm cylinder of a low load pressure are driven by hydraulic fluid flows supplied separately from the delivery ports 102*a* and 202*a* and the delivery ports 102*b* and 302*a*. Therefore, the delivery pressures of the delivery ports 102*b* and 302*a* on the arm cylinder 3*b*'s side (i.e., on the low load pressure actuator's side) can be controlled independently, by which the wasteful energy consumption due to the pressure loss in the pressure compensating valve 7*b* of the arm cylinder (low load pressure actuator) can be suppressed. Further, since the delivery flow rate of the subsidiary pump 202 specifically for the boom cylinder 3*a* of a low demanded flow rate is suppressed to a low level and the flow rate of the hydraulic fluid discharged from the unload valve 315 of the boom cylinder 3*a* to the tank is reduced, the bleed-off loss of the unload valve 315 can be reduced and operation with still higher efficiency becomes possible.

(2) At times of driving the bucket cylinder 3*d* whose demanded flow rate is low, the main pump 102 can be used at a point of higher efficiency since the bucket cylinder 3*d* can be driven by the main pump 102 alone without placing a burden on the subsidiary pump 202 or 302.

(3) In the combined operation of the traveling and the boom, the flows of the hydraulic fluid from three delivery ports (the first and second delivery ports 102*a* and 102*b* of the main pump 102 and the third delivery port 202*a* of the subsidiary pump 202) are merged together and supplied to the left and right travel motors and the other actuator (e.g., boom cylinder). Therefore, equal amounts of hydraulic fluid can be supplied to the left and right travel motors by operating the control levers of the left and right travel motors at equal input amounts (operation amounts). This makes it possible to drive the other actuator (e.g., boom cylinder) while maintaining the straight traveling property and to achieve excellent travel combined operation.

(4) The displacement of the main pump 102 is controlled by the torque control with the average pressure of the delivery pressures of the first and second delivery ports 102*a* and 102*b* and the average pressure of the delivery pressures of the third and fourth delivery ports 202*a* and 302*a*. Therefore, even in a combined operation in which the load pressure of one actuator increases significantly, the drop in the driving speed of the actuator due to a significant decrease in the displacement of the main pump 102 can be prevented and excellent operability in the combined operation can be secured. Especially, even when the load pressure of one travel motor increased significantly in the travel steering operation, the drop in the steering speed due to a significant decrease in the displacement of the main pump 102 can be prevented and an excellent steering feel can be secured.

Other Examples

While the above explanation of the embodiment has been given of a case where the construction machine is a hydraulic excavator and the first and second specific actuators are the boom cylinder 3*a* and the arm cylinder 3*b*, respectively, the first and second specific actuators can be actuators other than the boom cylinder or the arm cylinder as long as the actuators are those having greater demanded flow rates than other actuators and tending to have a great load pressure difference between each other when driven at the same time.

While the above explanation of the embodiment has been given of a case where the left and right travel motors 3*f* and 3*g* are the third and fourth specific actuators, the third and fourth specific actuators can be actuators other than the travel motors as long as the actuators are those achieving a prescribed function by having supply flow rates equivalent to each other when driven at the same time.

The present invention is applicable also to construction machines other than hydraulic excavators as long as the construction machine comprises actuators satisfying the above-described operating condition of the first and second specific actuators or the third and fourth specific actuators.

While the above explanation of the embodiment has been given of a case where the first pump device having the first and second delivery ports is the hydraulic pump 102 of the split flow type having the first and second delivery ports 102*a* and 102*b*, the first pump device may also be implemented by combining two variable displacement hydraulic pumps each having a single delivery port and driving two displacement control mechanisms (swash plates) of the two hydraulic pumps by use of the same regulator (pump control unit).

Furthermore, the load sensing system in the above embodiment is just an example and can be modified in various ways. For example, while the target differential pressure of the load sensing control is set in the above embodiment by arranging the differential pressure reducing valves for outputting the pump delivery pressures and the maximum load pressures as absolute pressures and leading the output pressures of the differential pressure reducing valves to the pressure compensating valves (to set a target compensation pressure) and to the LS control valves, it is also possible to lead the pump delivery pressures and the maximum load pressures to pressure control valves and LS control valves via separate hydraulic lines.

DESCRIPTION OF REFERENCE CHARACTERS

1: prime mover
102: variable displacement main pump (first pump device)
102*a*, 102*b*: first and second delivery ports
112: regulator (first pump control unit)
112*a*: low-pressure selection valve
112*b*: LS control valve
112*c*: tilting control piston for LS control
112*d*, 112*e*: tilting control piston for torque control (power control)
112*g*: pressure reducing valve
112*h*, 112*i*: restrictor
112*f*: tilting control piston for total torque control (total power control)
202: variable displacement subsidiary pump (second pump device)
202*a*: third delivery port
212: regulator (second pump control unit)
212*a*: LS control valve
212*c*: tilting control piston for LS control
212*d*: tilting control piston for torque control (power control)
302: variable displacement subsidiary pump (third pump device)
302*a*: fourth delivery port
312: regulator (third pump control unit)
312*a*: LS control valve
312*c*: tilting control piston for LS control
312*d*: tilting control piston for torque control (power control)
105: first hydraulic fluid supply line
205: second hydraulic fluid supply line
305: third hydraulic fluid supply line
405: fourth hydraulic fluid supply line
115: unload valve (first unload valve)
215: unload valve (third unload valve)
315: unload valve (second unload valve)
415: unload valve (fourth unload valve)
141: selector valve (first selector valve)
241: selector valve (second selector valve)
111, 211, 311, 411: differential pressure reducing valve
145, 146, 245, 246: selector valve
3*a*-3*h*: actuator
3*a*: boom cylinder (first specific actuator)
3*b*: arm cylinder (second specific actuator)
3*f*, 3*g*: left and right travel motors (third and fourth specific actuators)
4: control valve unit
6*a*-6*h*: flow control valve
7*a*-7*h*: pressure compensating valve
8*a*-8*h*: operation detection valve
9*c*-9*j*: shuttle valve
13: prime mover revolution speed detection valve
24: gate lock lever
30: pilot pump
31*a*, 31*b*, 31*c*: pilot hydraulic fluid supply line
32: pilot relief valve
40: selector valve (third selector valve)
52: boom operation detection hydraulic line
53: travel combined operation detection hydraulic line
54: arm operation detection hydraulic line
42, 43, 44: restrictor
100: gate lock valve
122, 123, 124*a*, 124*b*: control lever unit

The invention claimed is:

1. A hydraulic drive system for a construction machine, comprising:

a first pump device having first and second delivery ports;

a plurality of actuators which are driven by hydraulic fluid delivered from the first and second delivery ports;

a plurality of flow control valves which control the flow rates of the hydraulic fluid supplied from the first and second delivery ports to the actuators;

a plurality of pressure compensating valves each of which controls the differential pressure across each of the flow control valves so that the differential pressure becomes equal to a target differential pressure; and a first pump control unit including a first load sensing control unit which controls the displacement of the first pump device so that the delivery pressures of the first and second delivery ports become higher by a target differential pressure than the maximum load pressure of actuators driven by the hydraulic fluid delivered from the first and second delivery ports, wherein:

the plurality of actuators include a first actuator group and a second actuator group, the first actuator group including a first specific actuator, the second actuator group including a second specific actuator;

the first and second specific actuators are actuators having greater demanded flow rates than other actuators and tending to have a great load pressure difference between each other when driven at the same time;

the actuators of the first actuator group other than the first specific actuator and the actuators of the second actuator group other than the second specific actuator are actuators having less demanded flow rates than the first and second specific actuators;

the actuators of the first actuator group other than the first specific actuator are connected to the first delivery port of the first pump device via associated pressure compensating valves and flow control valves; and the actuators of the second actuator group other than the second specific actuator are connected to the second delivery port of the first pump device via associated pressure compensating valves and flow control valves; and wherein:

the hydraulic drive system further comprises:

a second pump device having a third delivery port to which the first specific actuator of the first actuator group is connected via an associated pressure compensating valve and flow control valve;

a third pump device having a fourth delivery port to which the second specific actuator of the second actuator group is connected via an associated pressure compensating valve and flow control valve;

a second pump control unit including a second load sensing control unit which controls the displacement of the second pump device so that the delivery pressure of the third delivery port becomes higher by a target differential pressure than the load pressure of the first specific actuator;

a third pump control unit including a third load sensing control unit which controls the displacement of the third pump device so that the delivery pressure of the fourth delivery port becomes higher by a target differential pressure than the load pressure of the second specific actuator;

a first selector valve which interrupts communication between the first delivery port and the third delivery port when only one or more actuators other than the first specific actuator are driven among the actuators of the first actuator group, while establishing communication between the first delivery port and the third delivery port when at least the first specific actuator is driven among the actuators of the first actuator group; and a second selector valve which interrupts communication between the second delivery port and the fourth delivery port when only one or more actuators other than the second specific actuator are driven among the actuators of the second actuator group, while establishing communication between the second delivery port and the fourth delivery port when at least the second specific actuator is driven among the actuators of the second actuator group.

2. The hydraulic drive system for a construction machine according to claim 1, wherein:

the actuators of the first actuator group other than the first specific actuator include a third specific actuator;

the actuators of the second actuator group other than the second specific actuator include a fourth specific actuator;

the third and fourth specific actuators are actuators achieving a prescribed function by having supply flow rates equivalent to each other when driven at the same time; and the hydraulic drive system further comprises a third selector valve which interrupts communication between the first delivery port and the second delivery port of the first pump device at times other than when the third and fourth specific actuators and at least another actuator are driven at the same time, while establishing communication between the first delivery port and the second delivery port of the first pump device when the third and fourth specific actuators and at least another actuator are driven at the same time.

3. The hydraulic drive system for a construction machine according to claim 1, further comprising a control pressure generation circuit which generates pressure for controlling hydraulic devices including the pressure compensating valves, the first pump control unit, the second pump control unit, and the third pump control unit, wherein:

the control pressure generation circuit is configured such that when only one or more actuators other than the first specific actuator are driven among the actuators of the first actuator group, a differential pressure between the delivery pressure of the first delivery port of the first pump device and the maximum load pressure of the actuators other than the first specific actuator is lead as the target differential pressure to the first pump control unit and the pressure compensating valves related to the actuators other than the first specific actuator;

when at least the first specific actuator is driven among the actuators of the first actuator group, a differential pressure between the delivery pressure of the first delivery port of the first pump device or the third delivery port of the second pump device and the maximum load pressure of the first actuator group is led as the target differential pressure to the first pump control unit and the pressure compensating valves related to the second pump device and the first actuator group;

when only one or more actuators other than the second specific actuator are driven among the actuators of the second actuator group, a differential pressure between the delivery pressure of the second delivery port of the first pump device and the maximum load pressure of the actuators other than the second specific actuator is led as the target differential pressure to the first pump control unit and the pressure compensating valves related to the actuators other than the second specific actuator; and when at least the second specific actuator is driven among the actuators of the second actuator group, a differential pressure between the delivery pressure of the second delivery port of the first pump device or the fourth delivery port of the third pump device and the maximum load pressure of the second actuator group is lead as the control pressure generation circuit leads the target differential pressure to the first pump control unit and the pressure compensating valves related to the third pump device and the second actuator group.

4. The hydraulic drive system for a construction machine according to claim 1, further comprising:

a first unload valve which shifts to the open state and returns the hydraulic fluid delivered from the first delivery port of the first pump device to a tank when the delivery pressure of the first delivery port of the first pump device becomes higher by a prescribed pressure than the maximum load pressure of the actuators other than the first specific actuator when only one or more actuators other than the first specific actuator are driven among the actuators of the first actuator group;

a second unload valve which shifts to the open state and returns the hydraulic fluid delivered from the first delivery port of the first pump device or the third delivery port of the second pump device to the tank when the delivery pressure of the first delivery port of the first pump device or the fourth delivery port of the second pump device becomes higher by a prescribed pressure than the maximum load pressure of the first actuator group when at least the first specific actuator is driven among the actuators of the first actuator group;

a third unload valve which shifts to the open state and returns the hydraulic fluid delivered from the second delivery port of the first pump device to the tank when the delivery pressure of the second delivery port of the first pump device becomes higher by a prescribed pressure than the maximum load pressure of the actuators other than the second specific actuator when only one or more actuators other than the second specific actuator are driven among the actuators of the second actuator group; and a fourth unload valve which shifts to the open state and returns the hydraulic fluid delivered from the second delivery port of the first pump device or the fourth delivery port of the second pump device to the tank when the delivery pressure of the second delivery port of the first pump device or the third delivery port of the third pump device becomes higher by a prescribed pressure than the maximum load pressure of the second actuator group when at least the second specific actuator is driven among the actuators of the second actuator group.

5. The hydraulic drive system for a construction machine according to claim 1, wherein:

the first pump control unit further includes a torque control unit having a first torque control actuator to which the delivery pressure of the first delivery port is led, a second torque control actuator to which the delivery pressure of the second delivery port is led, and a third torque control actuator to which average pressure of the delivery pressures of the third and fourth delivery ports is led;

the first and second torque control actuators being configured to decrease the displacement of the first pump device with the increase in average pressure of the delivery pressures of the first and second delivery ports; and the third torque control actuator being configured to decrease the displacement of the first pump device with the increase in the average pressure of the delivery pressures of the third and fourth delivery ports.

6. The hydraulic drive system for a construction machine according to claim 1, wherein:

the first and second specific actuators are a boom cylinder and an arm cylinder for driving a boom and an arm of a hydraulic excavator; and one of the actuators of one of the first and second actuator groups is a bucket cylinder for driving a bucket of the hydraulic excavator.

7. The hydraulic drive system for a construction machine according to claim 2, wherein the third and fourth specific actuators are left and right travel motors for driving a track structure of a hydraulic excavator.

* * * * *